United States Patent [19]

Phillips

[11] Patent Number: 4,590,032

[45] Date of Patent: May 20, 1986

[54] PROCESS FOR DRAW-FRACTURABLE YARN

[75] Inventor: Bobby M. Phillips, Kingsport, Tenn.

[73] Assignee: Eastman Kodak Company, Rochester, N.Y.

[21] Appl. No.: 624,086

[22] Filed: Jun. 25, 1984

Related U.S. Application Data

[62] Division of Ser. No. 390,739, Jun. 21, 1982, Pat. No. 4,472,477.

[51] Int. Cl.[4] ..... D01D 5/42

[52] U.S. Cl. ..... 264/555; 264/103; 264/147; 264/167; 264/177 F; 264/210.8; 264/290.5

[58] Field of Search ..... 264/147, 177 F, 154, 264/DIG. 47, 555, 103, 167, 210.8, 290.5; 428/224, 397

[56] References Cited

U.S. PATENT DOCUMENTS

| | | | |
|---|---|---|---|
| 2,783,609 | 3/1957 | Breen | 57/246 |
| 2,901,466 | 8/1959 | Kibler et al. | 528/288 |
| 3,219,739 | 11/1965 | Breen et al. | 57/246 |
| 3,242,035 | 3/1966 | White | 57/260 |
| 3,470,594 | 10/1969 | Kim | 264/DIG. 47 |
| 3,539,680 | 11/1970 | Fukushima et al. | 264/288.8 |
| 3,669,584 | 6/1972 | Yamada et al. | 425/173 |
| 3,857,232 | 12/1974 | Heinrich et al. | 57/284 |
| 3,857,233 | 12/1974 | Cardinal et al. | 57/284 |
| 3,946,548 | 3/1976 | Hino et al. | 57/289 |
| 3,962,189 | 6/1976 | Russin et al. | 528/277 |
| 4,095,319 | 6/1978 | Nelson | 28/273 |
| 4,245,001 | 1/1981 | Phillips et al. | 428/224 |
| 4,332,761 | 6/1982 | Phillips et al. | 264/177 F |
| 4,408,977 | 10/1983 | Phillips | 264/177 F |
| 4,472,477 | 9/1984 | Phillips | 57/248 |

*Primary Examiner*—Donald Czaja
*Assistant Examiner*—Hubert C. Lorin
*Attorney, Agent, or Firm*—Malcolm G. Dunn; William P. Heath, Jr.

[57] ABSTRACT

Process for draw-fracturing yarn the continuous filaments of which each have a cross-section comprising a body section and one or more wing members joined to the body section, the one or more wing members varying up to about twice their minimum thickness along their width, at the junction of the body section and one or more wing members the respective faired surfaces thereof define a radius of concave curvature (Rc) on one side of the cross-section and a generally convex curve located on the other side of the cross-section generally opposite the radius of concave curvature (Rc), the body section comprising about 25 to about 95% of the total mass of the filament and the wing members comprising about 5 to about 75%, the filament being further characterized by a wing-body interaction (WBI) defined by $$WBI = \left[\frac{(D\max - D\min)D\min}{2Rc^2}\right]\left[\frac{Lw}{D\min}\right]^2 \geqq 1$$

where the ratio of the width of the filament cross-section to the wing member thickness ($L_T$/Dmin) is $\leqq 30$ the process comprising drawing the yarn to a boiling water shrinkage of $\leqq 15\%$, fracturing the wing member portion of the filament utilizing fracturing means, and taking up the yarn.

6 Claims, 62 Drawing Figures

PROCESS FOR DRAW-FRACTURABLE YARN

This is a divisional of application Ser. No. 390,739 filed June 21, 1982, now U.S. Pat. No. 4,472,477 which issued Sept. 18, 1984.

DESCRIPTION

1. Technical Field

This invention relates to novel synthetic filaments, which may be used as textile filaments, and having a special geometry, which if subjected to preselected processing conditions, will give controlled fracturability so as to produce free protruding ends, and is directed specifically to other novel filament cross-sections and processes that will produce yarns coming within the scope of U.S. Pat. No. 4,245,001.

2. Background Art

Historically, fibers used by man to manufacture textiles, with the exception of silk, were of short length. Vegetable fibers such as cotton, animal fibers such as wool, and bast fibers such as flax all had to be spun into yarns to be of value in producing fabrics. However, the very property of short staple length of these fibers requiring that the yarns made therefrom be spun yarns also resulted in bulky yarns having very good covering power, good insulating properties and a good, pleasing hand.

The operations involved in spinning yarns from staple fibers are rather extensive and thus are quite costly. For example, the fibers must be carded and formed into slivers, then drawn to reduce the diameter, and finally spun into yarn.

Many previous efforts have been made to produce spun-like yarns from continuous filament yarns. For example, U.S. Pat. No. 2,783,609 discloses a bulky continuous filament yarn which is described as individual filaments individually convoluted into coils, loops and whorls at random intervals along their lengths, and characterized by the presence of a multitude of ring-like loops irregularly spaced along the yarn surface. U.S. Pat. No. 3,219,739 discloses a process for preparing synthetic fibers having a convoluted structure which imparts high bulk to yarns composed of such fibers. The fibers or filaments will have 20 or more complete convolutions per inch but it is preferred that they have at least 100 complete convolutions per inch. Yarns made from these convoluted filaments do not have free protruding ends like spun or staple yarns and are thus deficient in tactile aesthetics.

Other multifilament yarns which are bulky and have spun-like character include yarns such as that shown in U.S. Pat. No. 3,946,548 wherein the yarn is composed of two portions, i.e., a relatively dense portion and a blooming, relatively sparse portion, alternately occurring along the length of the yarn. The relatively dense portion is in a partially twisted state and individual filaments in this portion are irregularly entangled and cohere to a greater extent than in the relatively sparse portion. The relatively dense portion has protruding filament ends on the yarn surface in a larger number than the relatively sparse portion. The protruding filaments are formed by subjecting the yarn to a high velocity fluid jet to form loops and arches on the yarn surface, false twisting the yarn bundle, and then passing the yarn over a friction member, thereby cutting at least some of the looped and arched filaments on the yarn surface to form filament ends.

Yarns such as the texturized yarns disclosed in U.S. Pat. No. 2,783,609 and bulky multifilament yarns disclosed in U.S. Pat. No. 3,946,548 have their own distinctive characteristics but do not achieve the hand and appearance of the yarns made from the novel filament cross-sections of my invention.

Many attempts have been made to produce bulky yarns having the aesthetic qualities and covering power of spun staple yarns without the necessity of extruding continuous filaments or formation of staple fibers as an intermediate step. For example, U.S. Pat. No. 3,242,035 discloses a product made from a fibrillated film. The product is described as a multifibrous yarn which is made up of a continuous network of fibrils which are of irregular length and have a trapezoidal cross-section wherein the thin dimension is essentially the thickness of the original film strip. The fibrils are interconnected at random points to form a cohesively unitary or one-piece network structure, there being essentially very few separate and distinct fibrils existing in the yarn due to forces of adhesion or entanglement.

In U.S. Pat. No. 3,470,594 there is disclosed another method of making a yarn which has a spun-like appearance. Here, a strip or ribbon of striated film is highly oriented uniaxially in the longitudinal direction and is split into a plurality of individual filaments by a jet of air or other fluid impinging upon the strip in a direction substantially normal to the ribbon. The final product is described as a yarn in which individual continuous filaments formed from the striation are very uniform in cross-section lengthwise of the filaments. At the same time, there is formed from a web a plurality of fibrils having a reduced cross-section relative to the cross-section of the filament. FIGS. 8 and 9 of U.S. Pat. No. 3,470,594 show the actual appearance of yarn made in accordance with the disclosure.

The fibrillated film yarns of the prior art, which are generally characterized by the two disclosures identified above, have not been found to be useful in a commercial sense as a replacement or substitute for spun yarns made of staple fibers. These fibrillated film type yarns do not possess the necessary hand, the necessary strength, yarn uniformity, dye uniformity, or aesthetic structure to be used as an acceptable replacement or substitute for spun yarns for producing knitted and woven apparel fabrics.

Yarns of the type disclosed in U.S. Pat. Nos. 3,857,232 and 3,857,233 are bulky yarns with free protruding ends and are produced by joining two types of filaments together in the yarn bundle. Usually one type filament is a strong filament with the other type filament being a weak filament. One unique feature of the yarns is that the weak filaments are broken in the false twist part of a draw texturing process. The relatively weak filaments which are broken are subsequently entangled with the main yarn bundle via an air jet. Even though these yarns are bulky like staple yarns and have free protruding ends like spun yarns, fabrics produced from these yarns have aesthetics which are only slightly different from fabrics made from false twist textured yarns.

U.S. Pat. No. 4,245,001

Yarns made from the filament cross-sections of this invention, and as disclosed in greater detail in the aforementioned U.S. Pat. No. 4,245,001, have a spun yarn character, the yarn comprising a bundle of continuous filaments, the filaments having a continuous body section with at least one wing member extending from and along the body section, the wing member being intermittently separated from the body section, and a fraction of the separated wing members being broken to provide free protruding ends extending from the body section to provide the spun yarn character of the continuous filament yarn. The yarn is further characterized in that portions of the wing member are separated from the body section to form bridge loops, the wing member portion of the bridge loop being attached at each end thereof to the body section, the wing member portion of the bridge loop being shorter in length than the corresponding body section portion.

The free protruding ends extending from the filaments have a mean separation distance along a filament of about one to about ten millimeters and have a mean length of about one to about ten millimeters. The free protruding ends are randomly distributed along the filaments. The probability density function of the lengths of the free protruding ends on each individual filament is defined by $$f(x) = \frac{H(x)}{\int_0^{\infty} H(x)dx},$$

$x>0$, otherwise $f(x)=0$ where $f(x)$ is the probability density function $$\text{and } H(x) = \int_{-x}^{+x} \frac{\alpha}{2} e^{-[\alpha \frac{(x+z)}{2} + \frac{2\beta}{(x+z)}]} \cdot R \frac{(x-z)}{2} dz$$

and $R(\xi)$ is the log normal probability density function whose mean is $\mu_2+\ln w$ and variance is $\sigma_2^2$ or where $\mu_2$=mean value of $\ln(\mathrm{COT}\theta)$ with $\theta$=angle at which tearing break makes to fiber axis and w=width of the wing or $$R(\xi) = \frac{1}{\xi\sigma_2\sqrt{2\pi}} e^{[-\frac{1}{2}(\frac{ln\xi - lnw - \mu 2}{\sigma 2})2]}$$

ps and for $\mu_2=3.096$ $\sigma_2=0.450$ $0.11\ \mathrm{mm}^{-1} \leqq \alpha \leqq 2.06\ \mathrm{mm}^{-1}$ $0 \leqq \beta \leqq 1.25\ \mathrm{mm}^{-1}$ $0.0085\ \mathrm{mm} \leqq w \leqq 0.0173\ \mathrm{mm}$ The free protruding ends have a preferential direction of protrusion from the individual filaments and greater than 50% of the free protruding ends initially protrude from the body member in the same direction.

The mean length of the wing member portion of the bridge loops is about 0.2 to about 10.0 millimeters and the mean separation distance of the bridge loops along a filament is about 2 to about 50 millimeters The bridge loops are randomly distributed along the filaments.

The yarns made from filaments of this invention comprise continuous multifilaments of polyester, polyolefin or polyamide polymer, each having at least one body section and having extending therefrom along its length at least one wing member, the body section comprising about 25 to about 95% of the total mass of the filament and the wing member or wing members comprising about 5 to about 75% of the total mass of the filament, the filament being further characterized by a wing-body interaction (WBI) defined by $$WBI = \left[\frac{(D\max - D\min)D\min}{2Rc^2}\right]\left[\frac{Lw}{D\min}\right]^2 \geqq 1$$

where the ratio of the width of the filament cross-section to the wing member thickness ($L_T$/Dmin) is $\leqq 30$. The significance of the above symbols will be discussed later herein. The body of each filament remains continuous throughout the fractured yarn and thus provides load-bearing capacity, whereas the wings are broken and provide the free protruding ends.

It should be especially noted that the filament cross-sections disclosed in U.S. Pat. No. 4,245,001 are further characterized by a wing-body interaction defined by $$\left[\frac{(D\max - D\min)\ D\min}{2\ Rc^2}\right]\left[\frac{Lw}{D\min}\right]^2 \geqq 10$$

where the ratio of the width of the filament to the wing thickness ($L_T$/Dmin) is $\leqq 30$. For reasons given below, it should be noted that the numerical value of WBI$\geqq$10, as disclosed in U.S. Pat. No. 4,245,001, is different from the numerical value of WPI$\geqq$1 disclosed herein for the filament cross-sections of the present invention.

Although the fractured yarns made from the filament cross-section of the present invention come within the scope of the yarn claims in U.S. Pat. No. 4,245,001, the filament cross-sections of the present invention do not come within the scope of the filament claims in U.S. Pat. No. 4,245,001 because unexpectedly it was found that filament cross-sections having the special geometry disclosed herein will also give sufficient fracturability so as to produce a desirable level of free protruding ends but with wing-body interaction (WBI) values less than ten.

DISCLOSURE OF INVENTION

In accordance with the present invention, I provide a filament having a cross-section which has a body section and one or more wing members joined to the body section. The wing members vary up to about twice their minimum thickness along their width. At the junction of the body section and the one or more wing members the respective faired surfaces thereof define a radius of concave curvature (Rc) on one side of the cross-section and a generally convex curve located on the other side of the cross-section generally opposite the radius of curvature (Rc).

The body section constitutes about 25 to about 95% of the total mass of the filament and the wing member or wing members constitute about 5 to about 75% of the total mass of the filament, with the filament being further characterized by a wing-body interaction (WBI) defined by $$WBI = \left[\frac{(D\max - D\min)D\min}{2Rc^2}\right]\left[\frac{Lw}{D\min}\right]^2 \geqq 1$$

where the ratio of the width of the filament cross-section to the wing member thickness ($L_T$/Dmin) is $\leqq 30$.

The cross-section of the filament may have a single wing member, or two or more wing members. The filament cross-section may also have one or more wing members that are curved, or the wing member(s) may be angular.

The filament cross-section may also have two wing members and one of the wing members may be non-identical to the other wing member.

The thickness of the wing member(s) may vary up to about twice the minimum thickness and the greater thickness may be along the free edge of the wing member(s). Stated in another manner, a portion of each wing member may be of a greater thickness than the remainder of the wing member.

The periphery of the body section may define one central convex curve on the one side of the cross-section and one central concave curve located on the other side of the cross-section generally opposite the aforementioned one central convex curve.

The periphery of the body section may also define on the one side of the filament cross-section at least one central convex curve and at least one central concave curve connected together, and on the other side of the cross-section at least one central concave curve and at least one central convex curve connected together.

The periphery of the body section may further define on the one side of the filament cross-section two central convex curves and a central concave curve connected therebetween and on the other side of the cross-section two central concave curves and a central convex curve connected therebetween.

Each of the one or more wing members may have along the periphery of its cross-section on the one side of the filament cross-section a convex curve joined to the aforementioned radius of concave curvature (Rc) and on the other side of the cross-section a concave curve joined to the first-mentioned convex curve that is generally opposite the radius of concave curvature (Rc).

Each of the one or more wing members may also have along the periphery of the filament cross-section on the one side thereof two or more curves alternating in order of convex to concave with the latter-mentioned convex curve being joined to the aforementioned radius of concave curvature (Rc) and on the other side of the cross-section two or more curves alternating in order of concave to convex with the latter-mentioned concave curve being joined to the first-mentioned convex curve that is generally opposite the radius of concave curvature (Rc).

The filament cross-section may have four wing members and a portion of the periphery of the body section defines on one side thereof at least one central concave curve and on the opposite side thereof at least one central concave curve, each central concave curve being located generally offset from the other.

The body section of each filament remains continuous throughout the yarn when the yarn is fractured and thus provides load-bearing capacity, whereas the one or more wing members are broken and provide free protruding ends.

The filaments may be provided with luster-modifying means which may be finely dispersed titanium dioxide ($TiO_2$) or finely dispersed kaolin clay.

The filament may be comprised of a fiber-forming polyester such as poly(ethylene terephthalate) or poly-(1,4-cyclohexylenedimethylene terephthalate).

The filament disclosed herein may be oriented such that its elongation to break is less than 50% and has been heat stabilized to a boiling water shrinkage of $\leqq 15\%$, and thereby rendered fracturable.

In accordance with the present invention, I also provide a fractured yarn comprising filaments having the characteristics as set forth above wherein the yarn is characterized by a denier of about 15 or more, a tenacity of about 1.1 grams per denier or more, an elongation of about 8 percent or more, a modulus of about 25 grams per denier or more, a specific volume in cubic centimeters per gram at one-tenth gram per denier tension of about 1.3 to about 3.0, and with a boiling water shrinkage of $\leqq 15\%$.

The fractured yarn may have a laser characterization where the absolute b value is at least 0.25, the absolute value of a/b is at least 100 and the L+7 value ranges up to about 75. The absolute b value may also be about 0.6 to about 0.9, the absolute a/b value may be about 500 to about 1000; and the L+7 value may be about 0 to about 10. The absolute b value may still also be about 1.3 to about 1.7; the absolute a/b value may be about 700 to about 1500; and the L+7 value may be about 0 to about 5. Further, the absolute b value may be about 0.3 to about 0.6; the absolute a/b value may be about 1500 to about 3000; and the L+7 value may be about 25 to about 75.

The fractured yarn disclosed herein may still further be characterized by a normal mode Uster evenness of about 6% or less.

The fractured yarn made from the filaments disclosed herein may be of polyethylene terephthalate.

The filaments after spinning are drawn, heatset, and subjected to an air jet to fracture the wing member or wing members to provide a yarn having spun-like characteristics.

In accordance with the present invention, I further provide a process for melt spinning a filament having a body section and at least one wing member. The process involves (a) melt spinning a filament-forming polymeric material through a spinneret orifice the planar cross-section of which defines intersecting quadrilaterals in connected series with the L/W (length to width ratio) of each quadrilateral varying from 2 to 10 and with one or more of the defined quadrilaterals being greater in width than the width of the remaining quadrilaterals, with the wider quadrilaterals defining body sections and with the remaining quadrilaterials defining wing members (1) to form a filament having a cross-section comprising the aforementioned body section and the aforementioned at least one wing member joined to the body section, the at least one wing member varying up to about twice its minimum thickness along its width, at the junction of the body section and the at least one wing member the respective faired surfaces thereof define a radius of concave curvature (Rc) on one side of the cross-section and a generally convex curve located on the other side of the corss-section generally opposite the radius of curvature (Rc), the body section comprising about 25 to about 95% of the total mass of the filament and the wing member comprising about 5 to about 75%, the filament being further characterized by a wing-body interaction (WBI) defined by $$WBI = \left[\frac{(Dmax - Dmin)Dmin}{2Rc^2}\right]\left[\frac{Lw}{Dmin}\right]^2 \geqq 1$$

where the ratio of the width of the filament cross-section to the wing member thickness ($L_T$/Dmin) is $\leqq 30$, Dmax is the maximum thickness of the body section as shown in FIG. 2, Dmin is the thickness of the wing member for essentially uniform wing members and the minimum thickness close to the body section when the thickness of the wing member is variable, Rc is the radius of curvature of the intersection of the wing member and body section, Lw is the overall length of an individual wing member and $L_T$ is the overall length of the filament cross-section; (b) quenching the filament at a rate sufficient to maintain at least the aforementioned wing-body interaction (WBI); the spun filament of; and (c) taking up the filament under tension.

The process also involves uniformly drawing to a preselected level of textile utility a yarn comprising filaments having a wing-body interaction (WBI) defined by $$WBI = \left[\frac{(Dmax - Dmin)Dmin}{2Rc^2}\right]\left[\frac{Lw}{Dmin}\right]^2 \geqq 1$$

where the ratio of the width of the filament to the width of the wing member ($L_T$/Dmin) is $\leqq 30$, Dmax is the thickness or diameter of the body of the cross-section, Dmin is the thickness of the wing member for essentially uniform wing members and the minimum thickness close to the body when the thickness of the wing member is variable, $R_c$ is the radius of curvature of the intersection of the wing member and body section, Lw is the overall length of an individual wing member and $L_T$ is the overall length of the filament cross-section. The yarn is then stabilized to a boiling water shrinkage of $\leqq 15\%$; the wing member portion of the filament is fractured utilizing fracturing means; and then the yarn is taken up.

By "selected level of textile utility", it is meant yarns having generally elongations to break from about 8 to about 50%.

The fracturing apparatus may comprise a fluid fracturing jet operating at a brittleness parameter (Bp*) of about 0.03–0.8 for the yarn being fractured. A suitable fracturing jet that may be used is the one disclosed in U.S. Pat. No. 4,095,319 and also in FIG. 20 of the aforementioned U.S. Pat. No. 4,245,001. Details of this jet will also be given herein. The yarn may be a poly(ethylene terephthalate) yarn and the fluid fracturing jet may be operated at a brittleness parameter (Bp*) of about 0.03–0.6, and preferably at a brittleness parameter of about 0.03 to about 0.4.

The specific volume of the fractured yarn may be made to vary along the yarn strand by varying the fracturing jet air pressure.

The filaments of this invention are preferably made from polyester or copolyester polymer. Polymers that are particularly useful are poly(ethylene terephthalate) and poly(1,4-cyclohexylenedimethylene terephthalate). These polymers may be modified so as to be basic dyeable, light dyeable, or deep dyeable as is known in the art. These polymers may be produced as disclosed in U.S. Pat. Nos. 3,962,189 and 2,901,466, and by conventional procedures well known in the art of producing fiberforming polyesters. Also the filaments can be made from polymers such as poly(butylene terephthalate), polypropylene, or nylon such as nylon 6 and 66. However, the making of yarns described herein from these polymers is more difficult than the polyesters mentioned above. I believe this is attributable to the increased difficulty in making these polymers behave in a brittle manner during the fracturing process.

In general, it is well known in the art that the preservation of nonround cross-sections is dependent, among other things, on the viscosity-surface tension properties of the melt emerging from a spinneret hole. It is also well known that the higher the inherent viscosity (I.V.) within a given polymer type, the better the shape of the spinneret hole is preserved in the as-spun filament. These ideas obviously apply to the wing-body interaction parameter defined herein.

One major advantage of yarns made from the filaments of this invention is the versatility of such yarns. For example, a yarn with high strength, high frequency of protruding ends, short mean protruding end length with a medium bulk can be made and used to give improved aesthetics in printed goods when compared to goods made from conventional false twist textured yarn. On the other hand, a yarn with medium strength, high frequency of protruding ends with medium to long protruding end length and high bulk can be made and used to give desirable aesthetics in jersey knit fabrics for underwear or for women's outerwear.

The versatility is achieved primarily by manipulating the fracturing jet pressure and the specific cross-section of the filament. In general, increasing the fracturing jet pressure increases the specific volume and decreases the strength of the yarn. By varying the cross-section of the filaments within the parameters set forth herein, the yarn strength at constant fracturing conditions increases with increasing percent body section and the yarn specific volume increases with decreasing percent body section and increasing length/slot width.

Another major advantage of yarns made from filament cross-sections of this invention, when compared to staple yarns, is their uniformity along their length as evidenced by a low % Uster value (described in U.S. Pat. No. 4,245,001). This property translates into excellent knitability and weavability with the added advantage that visually uniform fabrics can be produced which possess distinctively staple-like characteristics, a combination of properties which has been hitherto unachievable.

Another of the major advantages of yarns made from filament cross-sections of this invention when compared to normal textile I.V. yarns in fabrics is excellent resistance to pilling. Random tumble ratings of 4 to 4.5 are very common (ASTM D-1375, "Pilling Resistance and Other Related Surface Characteristics of Textile Fabrics"). This is thought to occur because of the lack of migration of the individual protruding ends in the yarns.

Another major advantage when compared to previous staple-like yarns is the ease with which these yarns can be withdrawn from the package. This is a necessary prerequisite for good processability.

The filaments of this invention may be prepared by spinning the polymer through an orifice which provides a filament cross-section having the necessary wing-body interaction and the ratio of the width of the filament to the wing thickness as set forth earlier herein. The quenching of the fiber (as in melt spinning) must be such as to preserve the required cross-section. The filament is then drawn, heat set to a boiling water shrinkage of $\leqq 15\%$ and subjected to fracturing forces in a high velocity fracturing jet. Although the shape of the filaments must remain within the limits described, slight variations in the parameters may occur along the length of the filament or from filament to filament in a yarn bundle without adversely affecting the unique properties.

Yarns made from fractured filaments of the invention have a denier of 15 or more, a tenacity of about 1.1 grams per denier or more, an elongation of about 8 percent or more, a modulus of about 25 grams per denier or more, a specific volume in cubic centimeters per gram at one-tenth gram per denier tension of about 1.3 to 3.0, and a boiling water shrinkage of <15%. The yarn is further characterized by a laser characterization where the absolute b value is at least 0.25, the absolute a/b value is at least 100, and the L+7 value ranges up to about 75. Some particularly useful yarns have an absolute b value of about 0.6 to about 0.9, an absolute a/b value of about 500 to about 1000, and an L+7 value of 0 to about 10. Other particularly useful yarns have an absolute b value of about 1.3 to about 1.7, an absolute a/b value of about 700 to about 1500 and an L+7 value of 0 to about 5. Other yarns of the invention which are particularly useful have an absolute b value of about 0.3 to about 0.6, an absolute a/b value of about 1500 to about 3000, and an L+7 value of about 25 to about 75 and a Uster evenness of about 6% or less. For a discussion of the laser characterization, see U.S. Pat. No. 4,245,001.

For purposes of discussion, the following general definitions will be employed.

By brittle behavior is meant the failure of a material under relatively low strains and/or low stresses. In other words, the "toughness" of the material expressed as the area under the stress-strain curve is relatively low. By the same token, ductile behavior is taken to mean the failure of a material under relatively high strains and/or stresses. In other words, the "toughness" of the material expressed as the area under the stress-strain curve is relatively high.

By fracturable yarn is meant a yarn which at a preselected input temperature, generally room temperature, and when properly processed with respect to frequency and intensity of the energy input will exhibit brittle behavior in some part of the fiber cross-section (wing members in particular) such that a preselected level of free protruding broken sections (wing members) can be realized. It is within the framework of this general definition that the specific cross-section requirements for providing yarns possessing textile utility is defined.

According to the aforementioned U.S. Pat. No. 4,245,001, it is believed that the following basic ideas play important roles in the yarn-making process.

1. A properly specified cross-section such that the body remains continuous and the wing members produce free protruding ends when subjected to preselected processing conditions (WBI≧1) in the present invention.
2. A process in which there is a transfer of energy from a preselected source of a specified frequency range and intensity to fibers of the properly specified cross-section at a specified temperature such that the fiber material behaves in a brittle manner (0.03≦Bp*≦0.80).

Given a properly specified cross-section and a set of process conditions under which the material exhibits brittle behavior, the following sequence of events is believed to occur during the production of desirable yarns of the type disclosed herein.

1. The applied energy and its manner of application generates localized stresses sufficient to initiate cracks near the wing-body intersection. Obviously, low lateral strength helps in this regard.
2. The crack(s) propagates until the wing member(s) and body section are acting as individual pieces with respect to lateral movement, thus having the ability to entangle with neighbor pieces while still being attached to the body at the end of the crack.
3. Because of the intermingling and entangling, the total forces which may act on any given wing member at any instant can be the sum of the forces acting on several fibers. In this manner, the localized stress on a wing member can be sufficient to break the wing member with assistance from the embrittlement which occurs. It is known, for example, that mean stresses generated by a fracturing jet are at least one order of magnitude below the stresses required to break individual pieces (~0.2 G/D vs. ~2 G/D).
4. Finally, it is required that the intensity and effective frequency of the force application and the temperature of the fiber are such that the break in the wing member is of a brittle nature, thereby providing free protruding ends of a desirable length and linear frequency as opposed to loops and/or excessively long free protruding ends which would occur if the material behaved in a more ductile manner.

The following parameters have been found to be especially useful in characterizing the process required to obtain a useful yarn with free protruding ends, as disclosed in U.S. Pat. No. 4,245,001.

$$Bp^* = \frac{\Delta E_a \tau_a}{\Delta E_{na} \tau_{na}}$$

where Bp* is defined as the "brittleness parameter" and is dimensionless;

$\Delta E\ \tau$ is a product of strain and stress indicative of relative brittleness, where, in particular $\Delta E_{na}$ is the extension to break of the potentially fracturable yarn without the proposed fracturing process being operative;

$\Delta E_a$ is the extension to break of the potentially fracturable yarn with the proposed fracturing process being operative;

$\tau_a$ is the stress at break of the potentially fracturable yarn with the proposed fracturing process being operative;

$\tau_{na}$ is the stress at break of the potentially fracturable yarn without the proposed fracturing process being operative.

The input yarn conditions are constant in the a and na modes.

These parameters are also defined in terms of process conditions. As shown in FIG. 28 of U.S. Pat. No. 4,245,001, the basic experiment involves "stringing up" the yarn between two independently driven rolls as shown with the specific speed of the first or feed roll $V_1$ being preselected. The surface speed of the second or delivery roll $V_2$ is slowly increased until the yarn breaks with $V_2$ and the tension g in grams at the break being detected and recorded. This experiment is repeated five times with the proposed fracturing process being operative. In terms of the previously defined variables $$\Delta E_a = \frac{1}{5} \sum_{i=1}^{5} (V_{2ai} - V_1) \text{ (meters/min.)}$$

-continued $$\Delta E_{na} = \frac{1}{5} \sum_{i=1}^{5} (V_{2nai} - V_1) \text{ (meters/min.)}$$

$$\tau_a = \frac{\left(\frac{1}{5} \sum_{i=1}^{5} g_{ai}\right)\left(\frac{1}{5} \sum_{i=1}^{5} V_{2nai}\right)}{V_1} \text{ (gms.)}$$

$$\tau_{na} = \frac{\left(\frac{1}{5} \sum_{i=1}^{5} g_{nai}\right)\left(\frac{1}{5} \sum_{i=1}^{5} V_{2nai}\right)}{V_1} \text{ (gms.)}$$

Obviously mechanical damage by dragging over rough surfaces or sharp edges can influence Bp* values. However, for purposes of discussion, the word "process" means the actual part of the fracturing apparatus which is operated to influence fracturing only. In the case of air jets, it is the actual flow of the turbulent fluid with resulting shock waves which is used to fracture the yarn, not the dragging of the yarn over a sharp entrance or exit. Therefore the influence of the turbulently flowing fluid on Bp* is the only relevant parameter, not the mechanical damage. For example, suppose the following measurements were made with $V_1$=200 meters/-min.

| | | | | | | |
|---|---|---|---|---|---|---|
| Process Not Operative | $V_{2na}$ | 218 | 219 | 220 | 221 | 222 |
| | $g_{na}$gms. | 200 | 205 | 195 | 200 | 200 |
| Process Operative | $V_{2a}$ | 208 | 208 | 209 | 210 | 210 |
| | $g_a$gms. | 100 | 95 | 105 | 100 | 100 |

For this hypothetical example with the yarn at 23° C.

$\Delta E_a$=9 meters/min.

$\Delta E_{na}$=20 meters/min.

$\tau_a$=(100 gms.) (209 meters/min.)/(200 meters/min.)

$\tau_{na}$=(200 gms.) (220 meters/min.)/(200 meters/min.) thus $$Bp^* = \frac{(9)\ (100)\ (209)}{(20)\ (200)\ (220)} = 0.21$$

This parameter reflects the complex interactions among the type of energy input (i.e. turbulent fluid jet with associated shock waves), the frequency distribution of the energy input, the intensity of the energy input, the temperature of the yarn at the point of fracture, the residence time within the fracturing process environment, the polymer material from which the yarn is made and its morphology, and possibly even the cross-section shape. Obviously values of Bp* less than one suggest more "brittle" behavior. Values of Bp* of about 0.03 to about 0.80 have been found to be particularly useful. Note that it is possible to have a process (usually a fluid jet) operating on a yarn with a specified fiber cross-section of a specified denier/filament made from a specified polymer which behaves in a perfectly acceptable manner with respect to Bp* and by changing only the specified polymer the resulting Bp* will be an unacceptable value reflected in poorly fractured yarn. Thus acceptable Bp* values for various polymers may require significant changes in the frequency and/or intensity of the energy input and/or the temperature of the yarn and/or the residence time of the yarn within the fracturing process.

The preferred range of values of Bp* applies to a single operative process unit such as a single air jet. Obviously cumulative effects are possible and thereby several fracturing process units operating in series, each with a Bp* higher than 0.50 (say 0.50 to 0.80), can be utilized to make the yarn described herein.

Turbulent fluid jets with associated shock waves are particularly useful processes for fracturing the yarns described in this invention. Even though liquids may be used, gases and in particular air, are preferred. The drag forces generated within the jet and the turbulent intermingling of the fibers, characteristics well known in the art, are particularly useful in providing a coherent intermingled structure of the fractured yarns of the type disclosed herein.

For further details on Bp* "brittleness parameter", again see U.S. Pat. No. 4,245,001.

Procedures and instruments discussed herein are defined below.

Specific Volume

The specific volume of the yarn is determined by winding the yarn at a specified tension (normally 0.1 G/D) into a cylindrical slot of known volume (normally 8.044 $cm^3$). The yarn is wound until the slot is completely filled. The weight of yarn contained in the slot is determined to the nearest 0.1 mg. The specific volume is then defined as $$\text{Specific Volume at 0.1 G/D Tension} = \frac{8.044}{\text{wt. of yarn in gms.}} \ \frac{(cc)}{gm}$$

Boiling Water Shrinkage

The boiling water shrinkage concerns the change in length of a specimen when immersed in boiling water, distilled or demineralized, for a specified time. Either ASTM Test Method D-204 or D-2259 may be used, with the latter method being preferred.

Uster Evenness Test (% U)

ASTM Procedure D 1425—Test for Unevenness of Textile Strands.

Inherent Viscosity

Inherent viscosity of polyester and nylon is determined by measuring the flow time of a solution of known polymer concentration and the flow time of the polymer solvent in a capillary viscometer with an 0.55 mm. capillary and an 0.5 mm. bulb having a flow time of 100±15 seconds and then by calculating the inherent viscosity using the equation $$\text{Inherent Viscosity (I.V.)}, \ n_{0.50\%}^{25°}\ PTCE = \frac{\ln t_s}{\frac{t_o}{C}}$$

where:

ln=natural logarithm $t_s$=sample flow time $t_o$=solvent blank flow time

C=concentration grams per 100 mm. of solvent

PTCE=60% phenol, 40% tetrachloroethane Inherent viscosity of polypropylene is determined by ASTM Procedure D-1601.

Laser Characterization

The fractured yarn of this invention can be characterized in terms of the hairiness characteristics of the fractured yarn. The apparatus used is disclosed in U.S. patent application Ser. No. 762,704, filed Jan. 26, 1977, (now abandoned) in the name of Don L. Finley and entitled "Hairiometer". The description is incorporated herein by reference.

For purposes of clarification and explanation, the following symbols are used interchangeably.

$$B=b$$

$$M_T=A/B=a/b$$

Throughout this disclosure the terms

Laser absolute value b=laser $|b|$

Laser absolute value a/b=laser $|a/b|$ will be used also. The words "absolute value" carry the normal mathematical connotation such that Absolute value of $(-3)=|-3|=3$ or Absolute value of $(3)=|3|=3$.

The number of filaments protruding from the central region of the yarn of this invention can be thought of as the hairiness of the yarn. The words "hairiness", "hairiness characteristics" and words of similar import mean the nature and extent of the individual filaments that protrude from the central region of the yarn. Thus a yarn with a large number of filaments protruding from the central region would generally be thought of as having high hairiness characteristics and a yarn with a small number of filaments protruding from the central region of the yarn would generally be thought of as having low hairiness characteristics.

A substantially parallel beam of light is positioned so that the beam of light strikes substantially all the filaments protruding from the central region of a running textile yarn. The diffraction patterns created when the beam of light strikes a filament is sensed and counted. The fibers protruding from the central region of the yarn are scanned by the beam of light by incrementally increasing the distance between the running yarn and the axis of the beam of light so that the beam of light strikes a reduced number of filaments after each incremental increase in the distance. The diffraction patterns created when the beam of light strikes a filament are sensed and counted during the scanning. Data on the number of filaments counted at each distance representing the total of the incremental increases and each distance are then collected for typical yarns of this invention. Using the data there is developed a mathematical correlation of the number of filaments counted at each distance representing the total of the incremental increases as a function of a constant value and each distance. Preferably the mathematical correlation is developed by curve fitting an equation to the data points, the hairiness, or free protruding end, characteristics of the yarn are then expressed by mathematical manipulation of the mathematical correlation. A particular yarn to be tested for hairiness is then analyzed in the above-described manner and data representing the number of filaments counted at each distance are collected. The constant value of the mathematical correlation is then determined by correlating with the mathematical correlation, preferably by curve fitting, the collected data representing the number of filaments counted at each distance. The hairiness characteristics of the tested yarn are then determined by evaluating the mathematical expression of the hairiness characteristics of the yarn using the constant value. In addition the hairiness characteristics of the textile yarn are determined by considering the total number of filaments counted when the beam of light is at longer distances from the yarn.

A particular type of light is used to sense the filaments protruding from the central region of the yarn. Preferably the beam of light is a substantially parallel beam of light and also coherent and monochromatic. Although a laser is preferred, other types of substantially parallel coherent, monochromatic beams of light obvious to those skilled in the art can be used. The diameter of the beam of light should be small.

In use, a substantially parallel, coherent, monochromatic beam of light is positioned so that the beam of light strikes substantially all the filaments protruding from the central region of a running textile yarn. Preferably the textile yarn is positioned substantially perpendicular to the axis of the beam of light.

As the running yarn translates along its axis, the beam of light sees filaments protruding from the central region of the yarn as the filaments move through the beam of light. Each time the beam of light sees a filament, a diffraction pattern is created. During a predetermined interval of time a count of the number of filaments that protrude from the central region of the yarn during the interval of time is obtained by sensing and counting the diffraction patterns. By the term "diffraction pattern" we mean any suitable type of diffraction pattern such as a Fraunhofer or Fourier diffraction pattern. Preferably a Fraunhofer diffraction pattern is used.

Next the filaments protruding from the central region of the yarn are scanned by incrementally increasing the distance between the running yarn and the axis of the beam of light so that the beam of light strikes a reduced number of filaments after each incremental increase.

During the scanning function, wherein the distance between the yarn and the beam of light is incrementally increased, the number of filaments is sensed and counted by sensing and counting the number of diffraction patterns created as the filaments in the yarn move through the beam of light.

The number of incremental increases that is used can vary widely depending on the wishes of the operator of the device. In some cases only a few incremental increases can be used while in other cases 15 to 20, or even more, incremental increases can be used. Preferably 15 incremental increases are used. The incremental increases are continued until the longest filaments are no longer seen by the beam of light and consequently there are no filaments used.

In order to insure that a statistically valid filament count is obtained at the initial position and after each incremental increase in distance, the sequence of sensing, counting and incrementally increasing the distance is repeated a number of times and the filament count at each distance averaged. Although the number of times can vary, 8 is a satisfactory number. Thus each of the 16 filament counts would be the average of 8 testing cycles.

Next typical yarns are tested and the average number of filaments counted at each distance is recorded.

The data for the number of filaments counted at each distance representing the total of the incremental increases, N, are mathematically correlated as a function of a constant value and each distance, x. This mathematical correlation can be generally written as $N=f(K,x)$, where N is the number of filaments counted, K is a constant value, and x is each distance. Although a wide variety of means can be used to correlate the N and x data, we prefer that the data are plotted on a coordinate system wherein the values of N are plotted on the positive y axis and the values of x are plotted on the positive x axis. The character of these data can be more fully appreciated by referring to FIG. 21 of U.S. Pat. No. 4,245,001.

In FIG. 21 of U.S. Pat. No. 4,245,001 there are shown various curves representing the relationship between the number of filaments counted N and the distance x.

As will be appreciated from a consideration of the nature of the number of filaments counted as a function of the distance from the central region of the yarn, the largest number of filaments would be counted at the closer distances to the yarn, and the number of filaments counted would decrease as the beam of light moves away from the yarn during scanning. Thus in FIG. 21 of U.S. Pat. No. 4,245,001, when the log of the number of filaments N is plotted versus the distance x, the data are typically represented by a substantially straight line A. Although the particular mathematical correlation that can be used can vary widely depending on the precision that is required, the availability of data processing equipment, the type of yarn being tested, and the like, a mathematical correlation that gives results of entirely suitable accuracy for many textile yarns in $N=Ae^{-Bx}$, where N is the number of filaments counted at each distance, A is a constant, e is 2.71828, B is a constant, and x is each distance. This relationship is shown as curve A in FIG. 21 of U.S. Pat. No. 4,245,001. Although this relationship gives entirely satisfactory results for most typical yarns, many other correlations can be used for yarns of a particular character. For example if the filaments protruding from the central region of a yarn are substantially the same length and uniformly distributed, much as in a pipe cleaner, then there would be greater number of filaments counted at the closer distances and the number of filaments counted would diminish rapidly at some distance. This relationship could be expressed by a curve much like curve B in FIG. 21 of U.S. Pat. No. 4,245,001. Also for example, if the N and x data were from a yarn with only a few short filaments protruding from the central region, such as angora yarn, the N versus x data could be represented by curve C wherein a few filaments are counted at closer distances and the number of filaments decreases rapidly as the distance is increased. Although the correlation $N=Ae^{-Bx}$ gives good results for typical yarns, greater accuracy can be obtained using the correlation $N=Ae^{-(Bx+Cx2)}$. The correlation $N=Ae^{-(Bx+Cx2)}$ gives good fits to all curves A, B and C. As will be appreciated, there is an infinite number of correlations that can be used to express the relationship between N and x, both for most typical yarns, and for any particular type of yarn.

Since the general mathematical correlation $N=f(K,x)$ represents the relationship between the N and x data, useful information regarding the hairiness characteristics of the yarn can be mathematically expressed by use of the mathematical correlation. For example the area under the curve of the equation is reflective of the amount of hairiness of the yarn, or the total mass of filaments protruding from the central region of the yarn, $M_T$, and can be generally represented as $$M_T = \int_0^\infty f(K,x)dx$$

where B and C are greater than 0. Another hairiness characteristic that can be mathematically expressed by manipulation of the mathematical correlation is the slope of the curve of the equation $N=f(K,x)$. The slope of the mathematical correlation, represented as $d[N=f(K,x)]/dx$, is measured of the general character of the yarn. Thus if the number of filaments N is fairly uniform at shorter distances but rapidly decreases at longer distances, the N versus x curve would be somewhat like curve B in FIG. 21 of U.S. Pat. No. 4,245,001. If the number of filaments N decreased radically at shorter distances, the N versus x curve might be somewhat like curve C in FIG. 21. The slope of these curves would, of course, be different and would represent yarns with radically different hairiness characteristics.

In addition the hairiness characteristics of the yarn can be expressed as the total number of filaments counted when the beam of light is located at the larger distances from the yarn. For example when 16 distances are used in a preferred embodiment, the sum of the filaments counted at distances 7 through 16 can be used as one hairiness characteristic of the yarn, hereinafter called "laser L+7".

Consideration will be given to the various hairiness characteristics using the preferred mathematical correlation, $N=Ae^{-Bx}$. The total mass of filaments protruding from the central region of the yarn $M_T$, is $$M_T = \int_0^\infty Ae^{-Bx}dx$$

where B and C are greater than o, which can be resolved to $$M_T=A/B$$

The absolute value of the slope of the logarithm of N, i.e. $|d(\ln N)/dx|$, where $N=Ae^{-Bx}$, is B.

Next, the constant values for the mathematical correlation selected for use are determined by testing a particular yarn for hairiness characteristics by repeating the previously described procedure. First the yarn is positioned so that the beam of light strikes substantially all the filaments protruding from the central region of the yarn without striking the central region of the yarn and the number of filaments in the path of the beam of light is sensed and counted. Then yarn is scanned by incrementally increasing the distance between the running yarn and the axis of the beam of light so that the beam of light strikes a reduced number of filaments after each incremental increase in the distance. The number of filaments in the path of the beam of light is sensed and counted after each incremental increase. The procedure is repeated a number of times and a statistically valid average value of the number of filaments counted at each distance is determined.

The average values of the number of filaments counted at each distance N and the distances x are then used to determine the constant value in the mathematical correlation by correlating, with the mathematical correlation, the number of filaments counted at each distance N and the distance x. Preferably the correlation is accomplished by conventional curve-fitting procedures such as the method of least squares. Thus, since it is known from previous work that the relationship between the number of filaments counted at each distance and each distance can be expressed as some specific expression of the general relationship $N=f(K,x)$, the value of K can be determined by correlating the N and x data obtained with the equation $N=f(K,x)$.

Once the value of K is determined, the hairiness characteristics of the yarn can be determined by using the determined value of K and performing the required mathematics to solve whatever hairiness characteristics equation has been developed. For example if the mathematical correlation to be used is $N=Ae^{-Bx}$, then the various values of N and x obtained from testing a particular yarn can be used to determine values of A and B using conventional correlation techniques such as curve fitting using the method of least squares. Once A and B have been determined, the hairiness characteristic, $M_T$, and the slope of the mathematical correlation can be readily determined.

As will be appreciated by those skilled in the art, the function of determining the constant in the mathematical correlation and performing the mathematics to determine any particular hairiness characteristics can be accomplished either manually or through the use of conventional data processing equipment. For example the N and x values can be recorded on a punched tape and the punched tape can be used as the input to a digital computer which is programmed to mathematically express the hairiness characteristics of the yarn, $M_T$, by use of the mathematical correlation $N=Ae^{-Bx}$. Then the constant values A and B are determined by the computer by curve fitting the number of filaments counted at each distance N and the distance x with the mathematical correlation $N=Ae^{-Bx}$, using the method of least squares. Finally the computer evaluates the mathematical expression of the hairiness characteristics of the yarn, $M_T$, by dividing B into A.

BRIEF DESCRIPTION OF DRAWINGS

The details of my invention will be described in connection with the accompanying drawings in which.

BEST MODE FOR CARRYING OUT THE INVENTION

Figure 4:
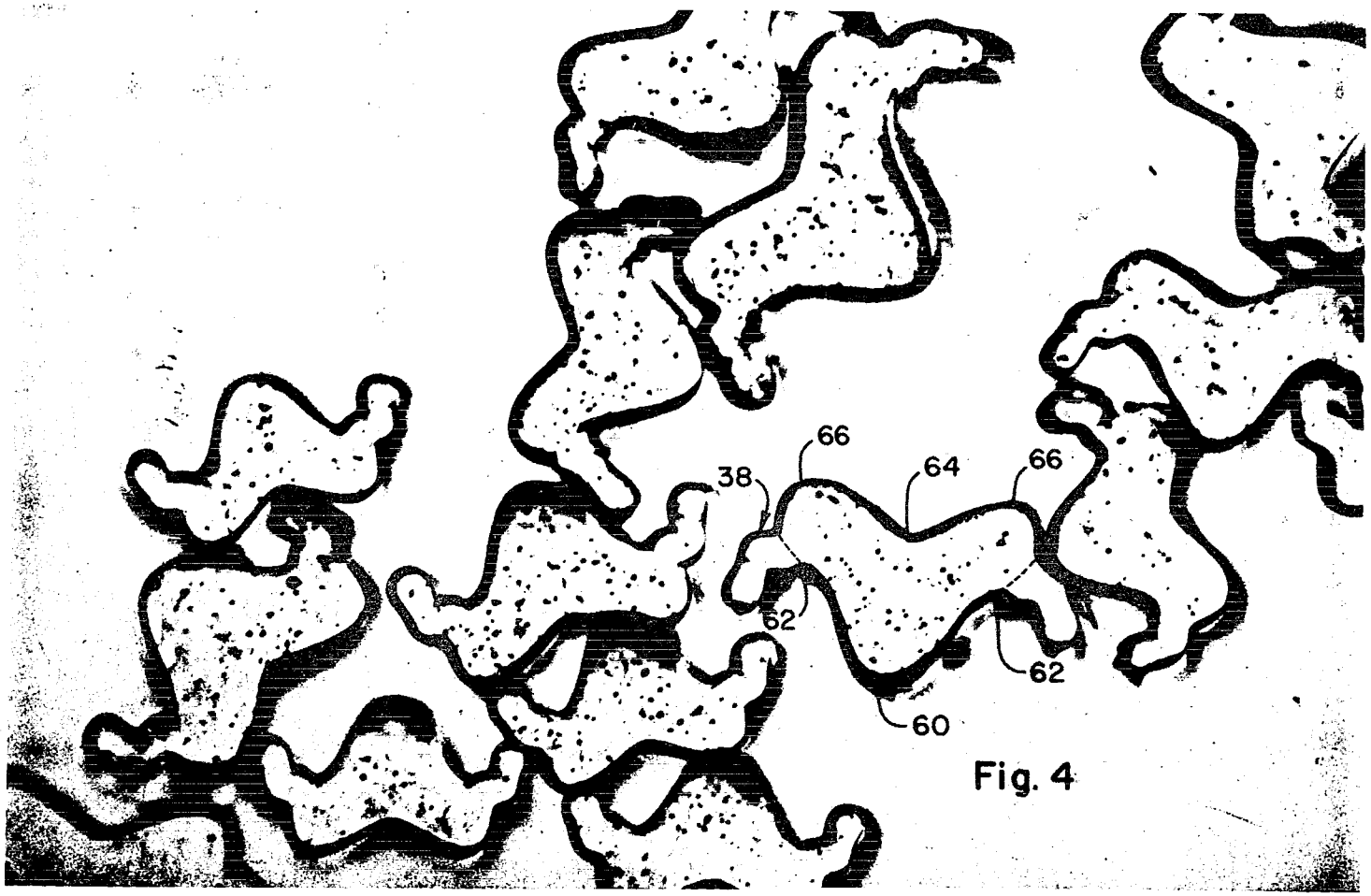
FIG. 4 is a photomicrograph of a filament cross-section of a filament spun from the spinneret orifice shown in FIG. 3.
Figure 6:
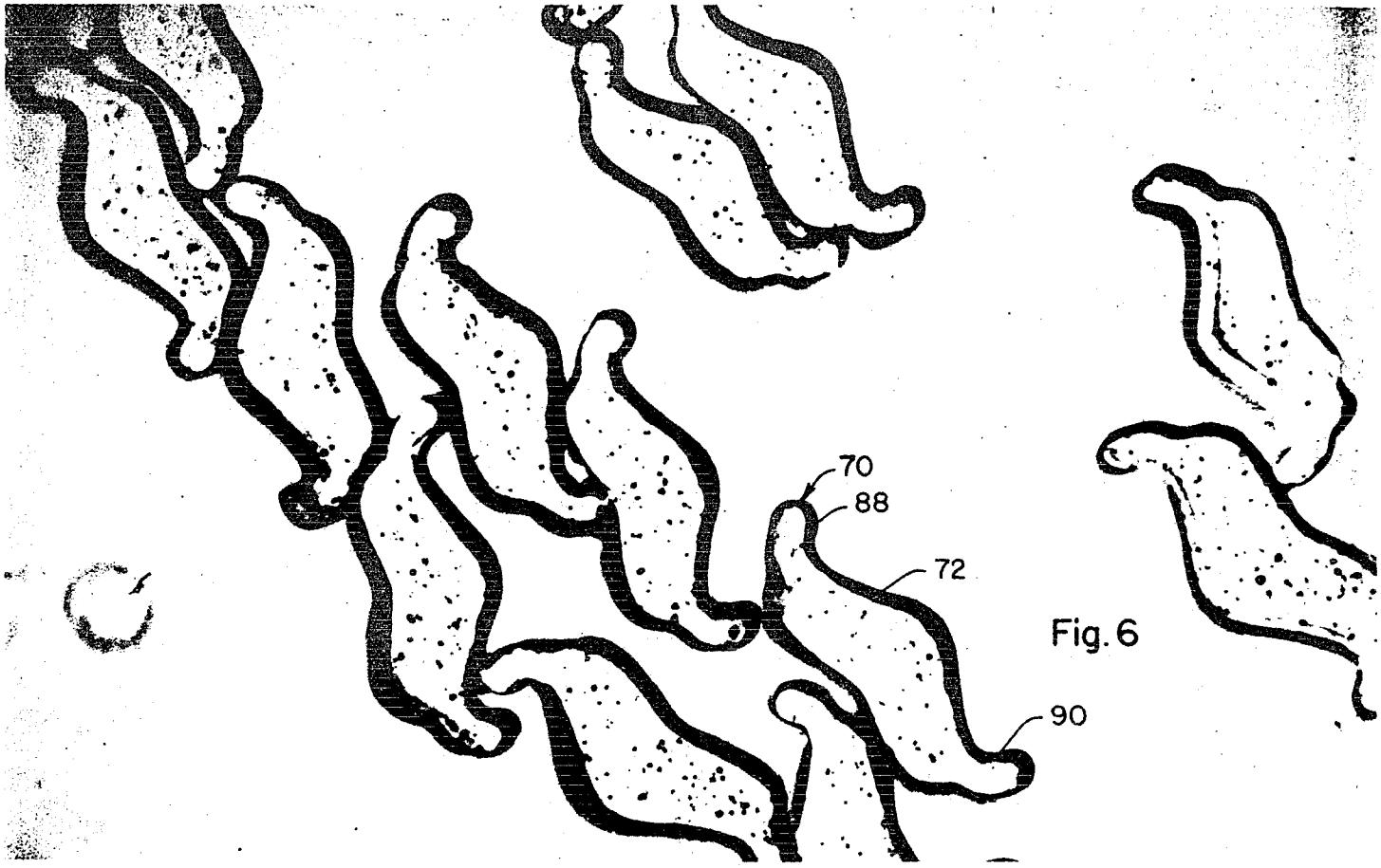
FIG. 6 is a photomicrograph of a filament cross-section of a filament spun from the spinneret orifice shown in FIG. 5.
Figure 8:
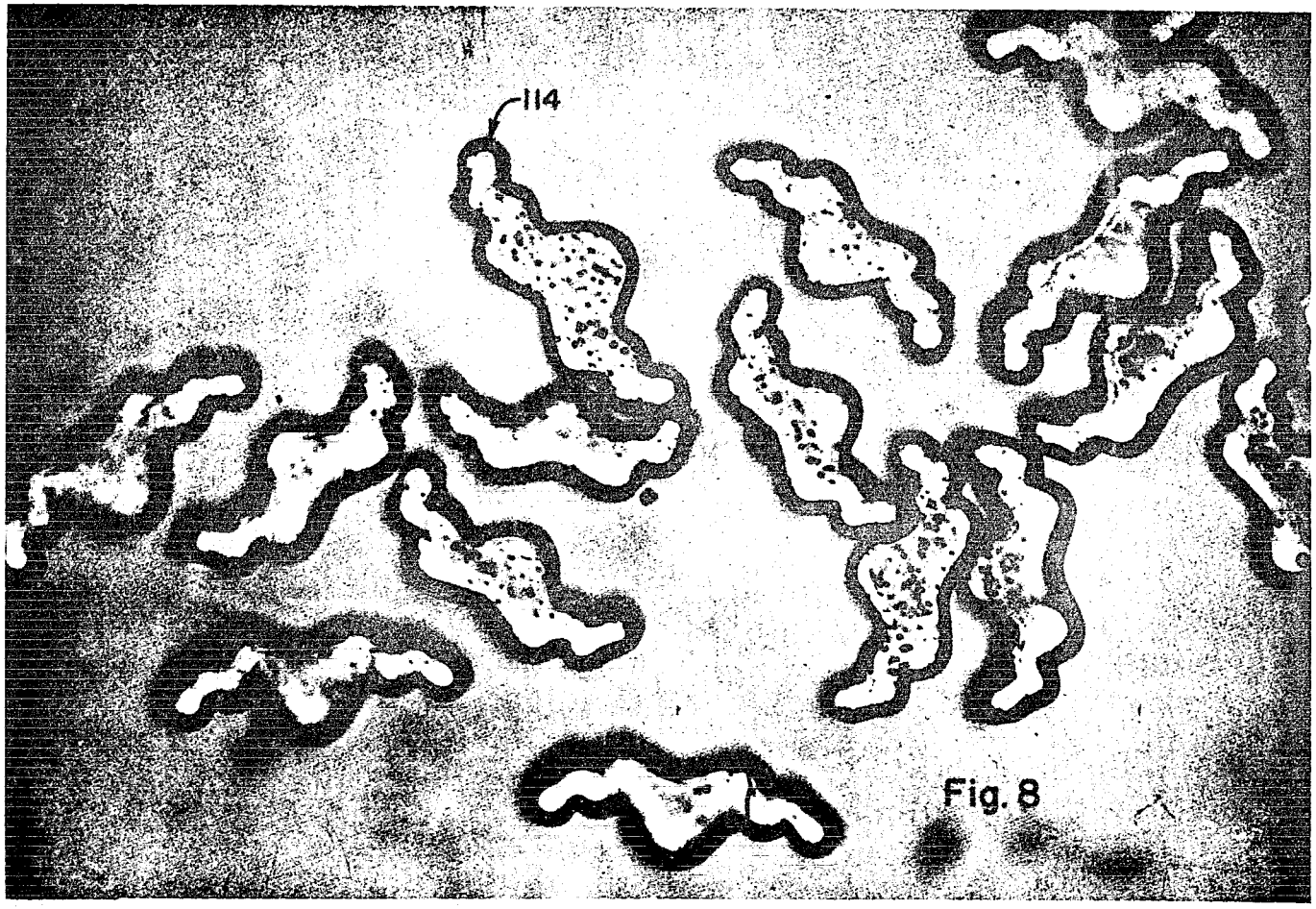
FIG. 8 is a photomicrograph of a filament cross-section of a filament cross-section spun from the spinneret orifice shown in FIG. 7.

In reference to the drawings, I show in FIGS. 4, 6 and 8 photomicrographs of the filament cross-section of typical filaments of my invention. It is critical to this invention that the cross-section of the filaments have geometrical features which are further characterized by a wing-body interaction (WBI) defined by $$WBI = \left[\frac{(D\max - D\min)D\min}{2Rc^2}\right]\left[\frac{Lw}{D\min}\right]^2 \geqq 1$$

where the ratio of the width of the filament cross-section to the wing member thickness ($L_T$/Dmin) is $\leqq 30$. The identification of and procedure for measuring these features is described in U.S. Pat. No. 4,245,001 but is repeated here since it is in part relevant to the present invention. It should also be noted that the result of WBI$\geqq$1 above differs from the result of WBI$\geqq$10 in the patent because the fiber characteristics disclosed in the patent are somewhat different from those disclosed herein, as heretofore mentioned. Referring in particular to the photomicrograph in FIG. 4, for instance, I illustrate how the fiber cross-sectional shape characterization is accomplished.

Figure 2:
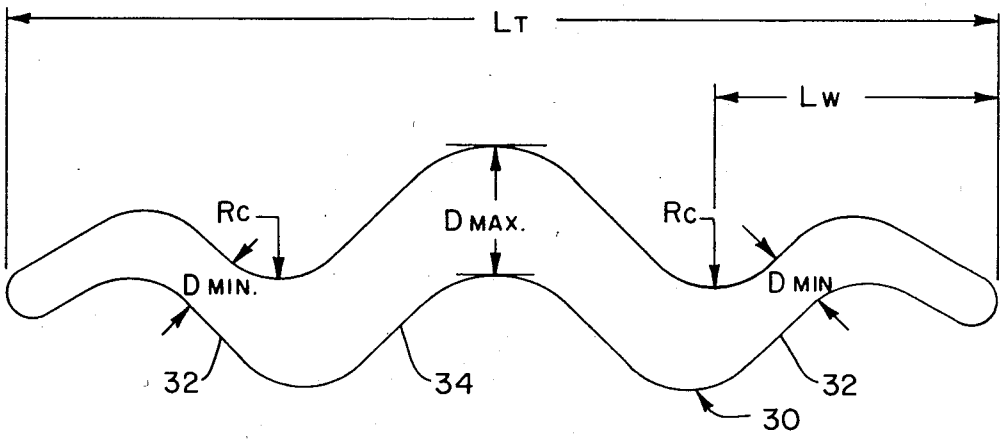
FIG. 2 is a drawing of a representative filament cross-section having a body section and two wing members and showing where the overall length of a wing member cross-section ($L_W$) and the overall or total length of a filament cross-section ($L_T$) are measured, where on the wing member the thickness (Dmin) of the wing member is measured, where on the body section the filament body diameter (Dmax) is measured and the location of the radius of curvature (Rc)

1. Make a negative of a filament cross-section at 500X magnification from the undrawn or partially oriented feeder yarns by embedding yarn filaments in wax, slicing the wax into thin sections with a microtome and mounting them on glass slides. Then make a photoenlargement from the negative that will be eight times larger than the original negative. (This procedure is an improvement over the one described in Column 18, lines 37–49 of U.S. Pat. No. 4,245,001.) It is important to note that drafting of undrawn or partially oriented filaments does not change the shape of the filaments. Thus, except for the inherent difficulties in preserving accurate representations of the fiber cross-section at 500X or greater and in cutting fully oriented and heatset fibers, the geometrical characterization can be accomplished using measurements made from the photoenlargements of fully oriented and heatset filaments.
2. Measure Dmin, Dmax, $L_W$ and $L_T$ using any convenient scale. These parameters are shown in FIG. 2, for instance, and are defined as follows:
   a. Dmin is the thickness of the wing member for essentially uniform wing members and the minimum thickness close to the body section when the thickness of the wing member is variable.
   b. Dmax is the maximum thickness of the body section as shown in FIG. 2.
   c. $L_T$ is the overall length of the filament cross-section.
   d. $L_W$ is the overall length of an individual wing member.

In all cases the above dimensions are measured from the outside of the "black" to the inside of the "white" in the photomicrograph. It was found more reproducible measurements can be obtained using this procedure. The "black" border is caused primarily by the nonperfect cutting of the sections, the nonperfect alignment of the section perpendicular to the viewing direction, and by interference bands at the edge of the filaments. Thus it is important in producing these photographs to be as careful and especially consistent in the photography and measuring of the cross-sections as is practically possible. Average values are obtained on a minimum of 10 filaments.

3. Measure the radius of curvature (Rc) of the intersection of the wing member and body section as shown in FIG. 2. Use the same length units which were used to measure Dmax, Dmin, etc. One convenient way is to use a circle template and match the curvature of the intersection to a particular circle curvature. Rc is measured at the two possible locations per filament cross-section and the sum total of the Rc's is averaged to get a representative Rc. For example, in FIG. 2 each filament cross-section has 2 Rc's which are averaged to give the final Rc. The averaged Rc's for individual filaments are then averaged to get an Rc which is indicative of the filaments in a complete yarn strand. Rc values are usually determined on a minimum of 20 filaments from at least two different cross-section photographs. It has been found that the ability of these winged cross-sections to provide a usable raw material for fracturing can be characterized by the following combinations of geometrical parameters.

$$WBI = \left[\frac{(D\max - D\min)D\min}{2Rc^2}\right]\left[\frac{Lw}{D\min}\right]^2 \geqq 1$$

where $(L_W/D\min)^2$ is proportional to the stress at the wing-body intersection if the wing members were considered as cantilevers only and $$\frac{(D\max - D\min)D\min}{2\,Rc^2}$$

is proportional to the stress concentration because of retained sharpness of the intersection. For example, see Singer, F. L., *Strength of Materials,* Harper and Brothers, NY, NY, 1951.

4. To determine the percent total mass of the body section and of the wing member(s), a photocopy of the cross-section is made on paper with a uniform weight per unit area. The cross-section is cut from the paper using scissors or a razor blade and then the wings are cut from the body along the dotted lines as shown in FIG. 4. A minimum of 20 individually similar cross-sections from at least two different cross-sections are photographed and cut with the total number of body sections being weighed collectively and the total number of wing members being weighed collectively to the nearest 0.1 mg. The percent areas in the wing member and body section are defined as $$\text{\% Cross-sectional Area in Wing Members} = \frac{\text{Collective weight of wing member(s) (gms.)}}{\text{Collective weight of wing member(s) and body section (gms.)}}$$

$$\text{\% Cross-sectional Area in Body Section} = \frac{\text{Collective weight of body section (gms.)}}{\text{Collective weight of wing member(s) and body section (gms.)}}$$

The filament cross-section, of course, is the subject of the present invention while the spinneret orifice is the subject of a separate invention filed concurrently with the present invention. The different spinneret orifices will be described herein, however, in order to show how some of the filament cross-sections of the present invention are obtained.

The cross-section of each of the spinneret orifices is defined by intersecting quadrilaterals in connected series, as illustrated by the dotted lines in a few of the spinneret orifice drawing figures. Each quadrilateral may be varied in length and width to a predetermined extent, with, of course, each side of the quadrilateral being longer (or shorter) than the corresponding opposite side, and with the angle of such intersection also varying to a predetermined extent in order that the resulting spun filament cross-section will have the necessary wing-body interaction (WBI). A "quadrilateral" is a geometrical plane figure having four sides and four angles.

Since the spinneret orifices disclosed herein are preferably and more economically formed by a suitable electric discharge machine, which operates by an erosion process, the resulting intersecting quadrilaterals will tend to be rounded in the areas as shown, rather than square. If one wanted to form perfectly square corners, at each of quadrilaterals a broach could be used after the electric discharge machine has completed the initial work.

The tips or extreme ends of the connected series of intersecting quadrilaterals are preferably rounded or are in the form of circular bores having a greater diameter than the width of the quadrilateral with which it intersects. The purpose of these circular bores is to promote a greater flow of polymer through the thinner end portions of the spinneret orifices so that the cross-sections of the spinneret orifice will be filled out with polymer during spinning.

Figure 1A:
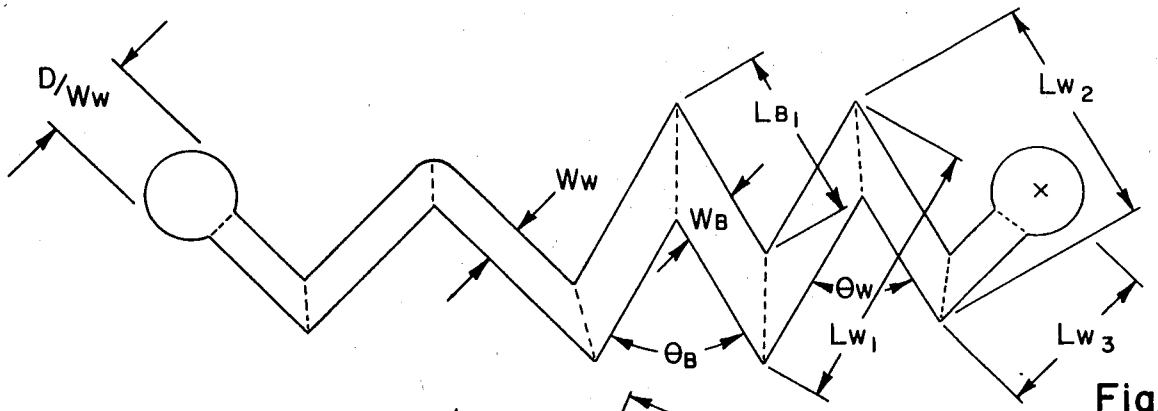
FIGS. 1A and 1B are drawings of representative spinneret orifices showing the nature and location of typical measurements to be made.

More specifically, and with reference to FIG. 1A in the drawings, the planar cross-section of each spinneret orifice defines intersecting quadrilaterals in connected series with the length-to-width ratio (L/W) of each quadrilateral varying from 2 to 10 and with at least one of the intersecting quadrilaterals being characterized as having a width greater than the width of the remaining quadrilateral(s), with the wider quadrilateral(s) defining body sections and with the remaining quadrilateral(s) defining wing member(s).

The number of intersecting quadrilaterals may vary from 5 to 14 and preferably 8; the number of body section quadrilaterals may vary from 1 to 4 and preferably 2; and the number of wing member quadrilaterals for each wing member may vary from 1 to 5 and preferably 3.

The angle $\theta_B$ between adjacent body section quadrilaterals may vary from about 30° to about 90° and preferably from about 45° to about 90°, and the angle $\theta_W$ between adjacent wing member quadrilaterals may vary from about 45° to about 150° and preferably from about 45° to about 90°.

The length-to-width ($L_B/W_B$) of the body section quadrilaterals may vary in proportional relationship from about 1.5 to about 10 and preferably from about 2 to about 5.5, the length-to-width ($L_W/W_W$) of the wing member quadrilaterals may vary from about 3 to about 10 and preferably from about 4 to about 6, and the maximum width of the body section quadrilateral, $W_B$*, to the minimum width of the body section quadrilateral, $W_B$, may vary from about 1 to about 3.

The diameter (D) of the circular base at the extremities of the spinneret orifice cross-section divided by the width of the wing member ($W_W$) may vary in proportional relationship from about 1.5 to about 2.5 and preferably 2.

Figure 1B:
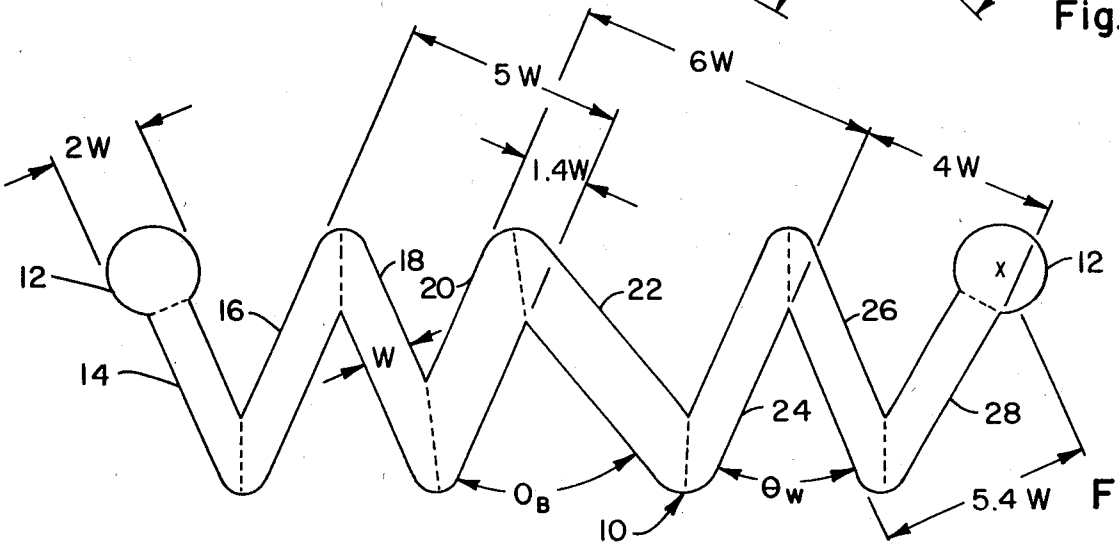
Figures 9, 10:
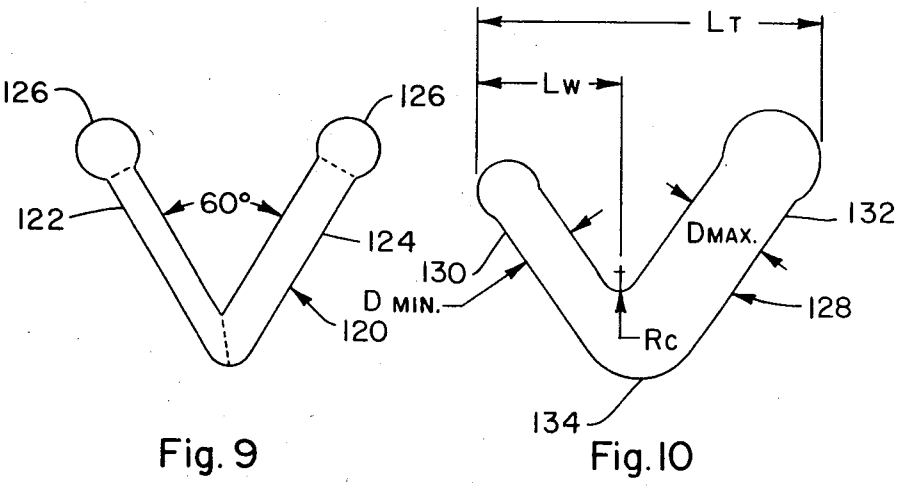
FIG. 9 is a drawing of a spinneret orifice having a single-segment body section and a single-segment wing member having an angle therebetween of about 60°.
FIG. 10 illustrates the approximate configuration a filament cross-section will have when spun from the spinneret orifice shown in FIG. 9.

In reference to FIG. 1B, 10 illustrates a characteristic form that a spinneret orifice cross-section made by an electric erosion process may have to spin the filament cross-section of this invention. The designated dimensions of the circular bores 12 and the intersecting quadrilaterals 14, 16, 18, 20, 22, 24, 26 and 28 are all normalized to wing member quadrilateral dimension W such that W is always 1. Dimension W should be as small as practical consistent with good spinning practice. For instance, W may be 84 microns. An intersecting quadrilateral for a body section is preferably about 1.4W, as may be observed from FIG. 1B, and the circular bore at the extremities of the spinneret orifice cross-section may preferably be about 2W. The wider quadrilaterals 20, 22 form the body section and the remaining quadrilaterals form the wing members. The different widths illustrated are in proportional relationships to the width W, such as 5W, 6W, etc., as illustrated.

In FIG. 2, 30 illustrates a characteristic form that a filament cross-section may have, showing the approximate locations of the minimum dimension (Dmin) of the wing members 32; the maximum dimension (Dmax) of the body section 34; the radius of curvature ($R_c$) in the area of which fracturing takes place, thereby separating the wing member from the body section; the wing member width ($L_W$); and the width ($L_T$) of the filament cross-section.

Figure 3:
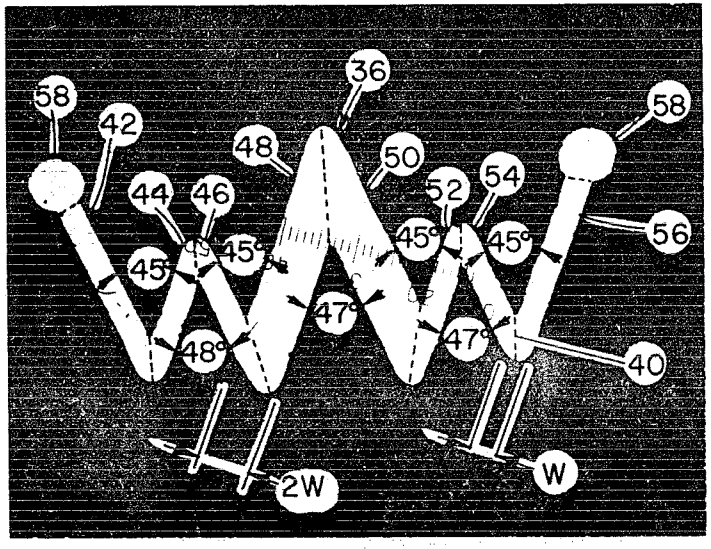
FIG. 3 is a photomicrograph of one embodiment of a spinneret orifice in a spinneret.

In reference now to FIGS. 3 and 4, FIG. 3 shows a photomicrograph of a spinneret orifice planar cross-section 36 and FIG. 4 shows a photomicrograph of a filament cross-section 38 that is spun from the spinneret orifice cross-section shown in FIG. 3. The intersections of the quadrilaterals are represented by dotted lines, such as shown at 40. The planar cross-section is thus defined by intersecting quadrilaterals 42, 44, 46, 48, 50, 52, 54 and 56, with quadrilaterals 48 and 50 being wider than the others and thus representing the body intersecting quadrilaterals, while the others represent the wing member intersecting quadrilaterals. The extremities of the spinneret cross-section are defined by circular bores 58. The width of each body section quadrilateral 48,50 is 2W, as shown, while the wing member quadrilateral is W.

In the filament cross-section 38 shown in FIG. 4, it will be observed that there are a number of concave and convex curves along the periphery of the cross-section, such as a rather central appearing convex curve 60 which is flanked on either side by a concave curvature 62 and is positioned generally opposite a central appearing concave curve 64, the latter in turn having adjacent on either side convex curves 66. These curves, and the others shown but not specifically designated, bear a one-for-one correspondence with the number of quadrilateral intersections in the spinneret orifice cross-section 36. The size of the curves is dependent upon whether they were spun from the body section or wing member quadrilaterals, the length and width of the quadrilaterals and the angles between adjacent intersecting quadrilaterals of the spinneret orifice cross-section. The body section of the filament cross-section essentially is outlined in part by the central appearing convex curve 60, the oppositely located concave curve 64 and its adjacent convex curves 66. The concave curves 62 form the radius of curvatures (Rc) which join the wing members to the body section.

When polymer is spun from the spinneret orifice cross-section 36, for instance, there is a greater mass of flow through the body section than the wing member portions so that the body section polymer is flowing faster than the wing member polymer. As the body section polymer and wing member polymer begin to equalize, the wing member polymer speeds up while the body section polymer slows down with the results that the body section tends to expand while the wing members tend to contract. Hence, also, the angles in the filament cross-section tend to open out slightly over the angles shown in the spinneret cross-section orifice.

For instance, the angle $\theta_W$ between intersecting quadrilaterals 42 and 44 is about 45°; between intersecting quadrilaterals 44 and 46 is about 48°; between intersecting quadrilaterals 46 and 48 is about 45°; between intersecting quadrilaterals 50 and 52 is about 45°; between intersecting quadrilaterals 52 and 54 is about 47°; and between intersecting quadrilaterals 54 and 54 is about 45°. The angle $\theta_B$ between intersecting quadrilaterals 48 and 50 is about 47°.

Figure 5:
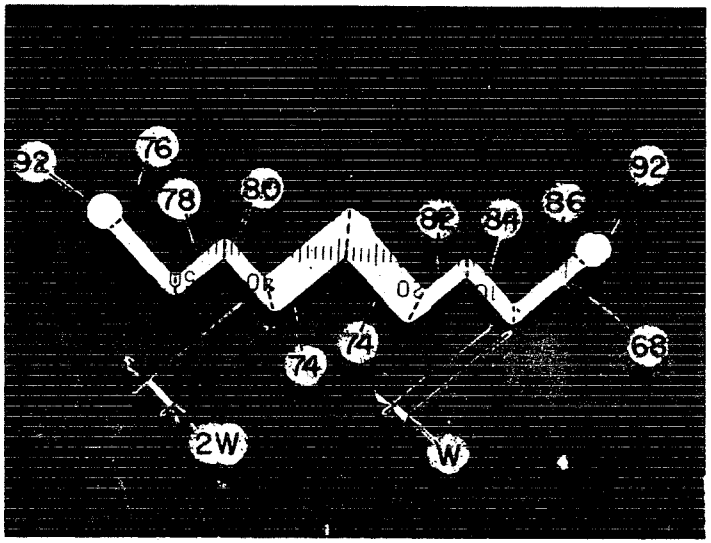
FIG. 5 is a photomicrograph of a second embodiment of a spinneret orifice in a spinneret.

The spinneret orifice cross-section 68 in FIG. 5 and the filament cross-section 70 in FIG. 6 more graphically illustrate the expansion of the resulting body section of the filament cross-section and the contraction of the wing member portion of the filament cross-section. Note the appearance of the length of the body section 72 in FIG. 6 by comparison to the length of expanse across the larger intersecting quadrilaterals 74 in FIG. 5, whereas the longer appearing expanse of length across the wing member quadrilaterals 76, 78, 80 or 82, 84, 86 in FIG. 5 result in shorter appearing wing members 88 or 90 in the filament cross-section 70 shown in FIG. 6. The width of each body section quadrilateral 74 is 2W, as shown in FIG. 5. The extremities of the spinneret cross-section are defined by circular bores 92.

Table I below shows the shape factor parameters, for instance, of the filament cross-section 70, the measurements having been made in the manner as described for four filament cross-sections of the type represented by filament cross-section 70.

TABLE I

| | Example 1 | Example 2 | Example 3 | Example 4 |
|---|---|---|---|---|
| Dmax mm | 64.0 | 65.0 | 70.0 | 69.0 |
| Dmin mm | 24.0 | 24.0 | 26.0 | 24.0 |
| Rc mm | 17.5 | 18.0 | 16.0 | 19.0 |
| $L_W$ mm | 35.0 | 41.0 | 36.0 | 40.0 |
| $L_T$ mm | 237.0 | 227.0 | 235.0 | 228.0 |
| WBI | 3.333 | 4.432 | 4.283 | 4.155 |
| $L_T$ Dmin | 9.87 | 9.46 | 9.04 | 9.50 |

In reference to TABLE I, the mean and percent coefficient of variation of WBI for these four filaments representing the population of filaments in FIG. 6 is 4.05 and 12.1%, respectively.

Figure 7:
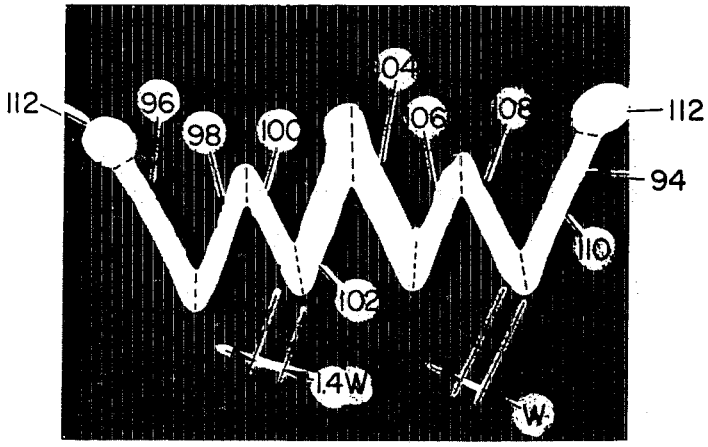
FIG. 7 is a photomicrograph of a third embodiment of a spinneret orifice in a spinneret.

The spinneret orifice cross-section 94 in FIG. 7 has intersecting quadrilaterals 96, 98, 100, 102, 104, 106, 108 and 110, with the wider intersecting quadrilaterals 102 and 104 designating the body section quadrilaterals while the others designated wing members intersecting quadrilaterals. The width of the body section quadrilaterals is 1.4W, as shown. The extremities of the spinneret orifice cross-section are defined by bores 112, which have a diameter of about 2W.

It will be noted in FIG. 7 that the width of the two body section intersecting quadrilaterals 102, 104 is somewhat irregular near their intersection. This was due to a defect in the electric erosion process for this particular spinneret and would not be representative of a conventional operating electric erosion process.

FIG. 8 shows the resulting filament cross-section 114 from the spinneret orifice cross-section of FIG. 7. Note the clear definitions of the concave and convex curves, which is due in part to use of a preferred 1.4W body section quadrilateral (FIG. 7). Compare the filament cross-section of FIG. 8 with that of FIG. 4, for instance, where the spinneret body section width is 2W. FIG. 8 reflects more clearly the one-for-one correspondence of the quadrilateral intersections than the filament cross-section of FIG. 4.

Single Wing Member

The spinneret orifice cross-section 120 in FIG. 9 has intersecting quadrilaterals 122, 124 with the single wider intersecting quadrilateral 124 forming a single segment body section and the other single intersecting quadrilateral 122 forming a single segment wing member. The two segments have an angle therebetween of about 60°. The width of the body section quadrilateral is about 1.4W while the width of the wing member quadrilateral is W. The extremities of the spinneret orifice cross-section are defined by circular bores 126.

FIG. 10 shows the resulting filament cross-section 128 as spun from the spinneret orifice cross-section of FIG. 9, with the filament cross-section having a single wing member 130, which is connected to the body section 132, and a generally convex curve 134 located on the other side of the filament cross-section generally opposite the illustrated radius of curvature (Rc).

Figure 11:
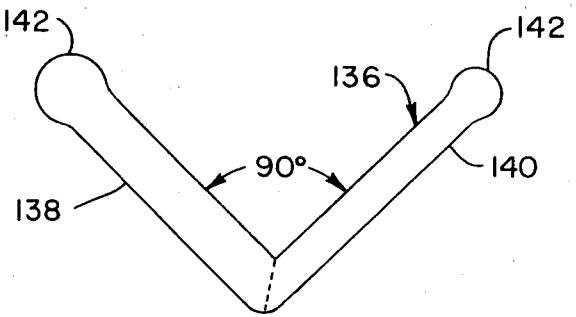
FIG. 11 is a drawing of a spinneret orifice having a single-segment body section and a one-segment single wing member having an angle therebetween of about 90°.

The spinneret orifice cross-section 136 in FIG. 11 has intersecting quadrilaterals 138, 140 with the single wider intersecting quadrilateral 138 also forming a single segment body section and the other single intersecting quadrilateral 140 also forming a single segment wing member. The two segments have an angle therebetween of about 90°. The width of the body section quadrilateral is about 1.4W while the width of the wing member quadrilateral is W. The extremities of the spinneret orifice cross-section are defined by circular bores 142.

Figure 12:
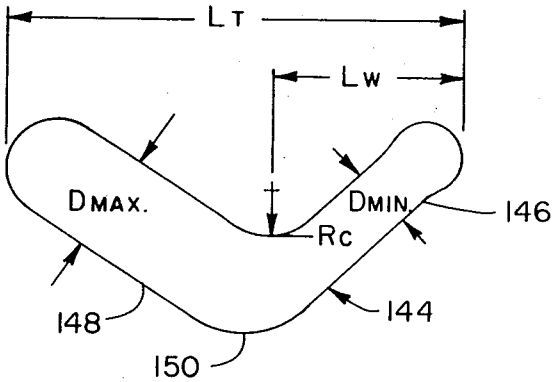
FIG. 12 illustrates the approximate configuration a filament cross-section will have when spun from the spinneret orifice shown in FIG. 11.

FIG. 12 shows the resulting filament cross-section 144 as spun from the spinneret orifice of FIG. 11. This filament cross-section also has a single wing member 146, which is connected to the body section 148, and a generally convex curve 150 located on the other side of the filament cross-section generally opposite radius of curvature (Rc).

Figure 13:
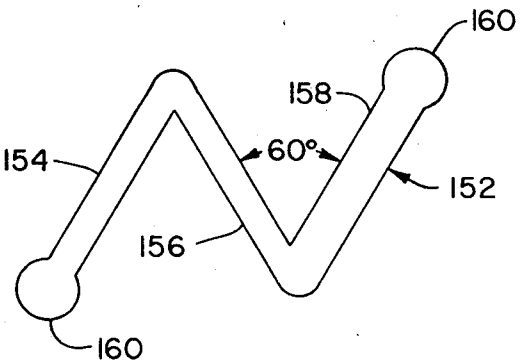
FIG. 13 is a drawing of a spinneret orifice having a single-segment body section and a two-segment single wing member.

The spinneret orifice cross-section 152 in FIG. 13 has intersecting quadrilaterals 154, 156 and 158 with the single wider intersecting quadrilateral 158 forming a single segment body section and the other two intersecting quadrilaterals 154, 156 forming a two segment, single wing member. The angle between the body section and wing member is about 60°. The width of the body section quadrilateral is about 1.4W while the width of the wing member quadrilaterals is W. The extremities of the spinneret orifice cross-section are defined by circular bores 160°.

Figure 14:
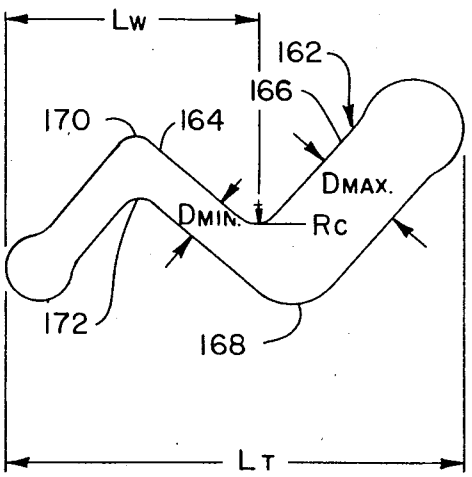
FIG. 14 illustrates the approximate configuration a filament cross-section will have when spun from the spinneret orifice shown in FIG. 13.

FIG. 14 shows the resulting filament cross-section 162 as spun from the spinneret orifice cross-section of FIG. 13, with the filament cross-section having a single wing member 164, which is connected to the body section 166, and a generally convex curve 168 located on the other side of the filament cross-section generally opposite the illustrated radius of curvature (Rc). The single wing member 164 has along its periphery a convex curve 170 located generally opposite a concave curve 172.

Two Wing Members

Figure 15:
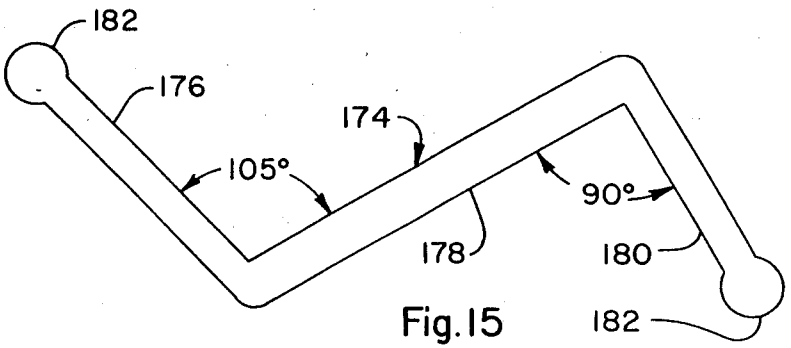
FIG. 15 is a drawing of a spinneret orifice having a single-segment body section and a one-segment wing member intersecting at about 105° at one end of the body section and another one-segment wing member intersecting at about 90° with the other end of the body section, and with the lengths of the wing members differing from each other.

The spinneret orifice cross-section 174 in FIG. 15 has intersecting quadrilaterals 176, 178, 180 with the single wider intersecting quadrilateral 178 forming a single segment body section and the other single intersecting quadrilaterals 176 and 180 forming two single segment wing members. The angles between the body section and the wing members are, respectively, about 105° and 90°, as illustrated in FIG. 15. The width of the body section quadrilateral is about 1.4W while the width of the wing member quadrilaterals is W. The extremities of the spinneret orifice cross-section are defined by circular bores 182.

Figure 16:
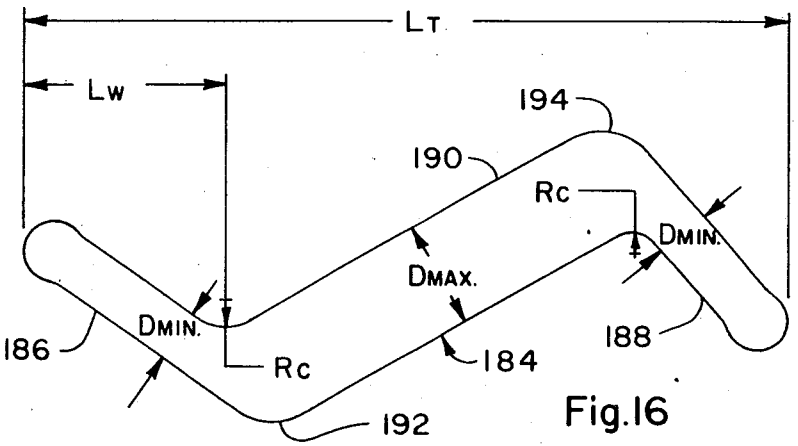
FIG. 16 illustrates the approximate configuration a filament cross-section will have when spun from the spinneret orifice shown in FIG. 15.

FIG. 16 shows the resulting filament cross-section 184 as spun from the spinneret orifice cross-section of FIG. 15, with the filament cross-section having two wing members 186, 188, which are connected, respectively, to an end of the body section 190, and two generally convex curves 192, 194 each located on the other side of the filament cross-section generally opposite one of the illustrated radius of curvatures (Rc). Wing member 188 is longer than wing member 186.

Figure 17:
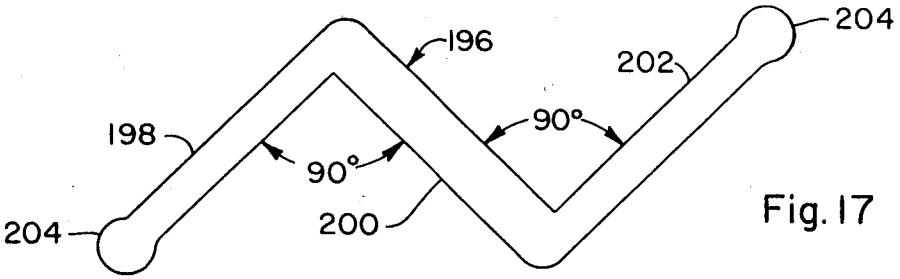
FIG. 17 is a drawing of a spinneret orifice having a single-segment body section and a one-segment wing member intersecting at about 90° at each end of the body section, and with the lengths of the wing members being the same.

The spinneret orifice cross-section 196 in FIG. 17 has intersecting quadrilaterals 198, 200, 202 with the single wider intersecting quadrilateral 200 forming a single segment body section and the other single intersecting quadrilaterals 198 and 202 also forming two single segment wing members. The angles between the body section and the wing members are each about 90° as illustrated in FIG. 17. The width of the body section is about 1.4W while the width of the wing member quadilaterals is W. The extremities of the spinneret orifice cross-section are defined by circular bores 204.

Figure 18:
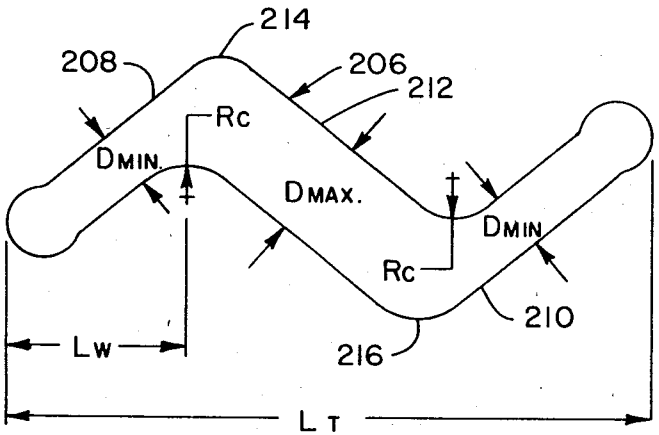
FIG. 18 illustrates the approximate configuration a filament cross-section will have when spun from the spinneret orifice shown in FIG. 17.

FIG. 18 shows the resulting filament cross-section 206, with the filament cross-section having two wing members 208, 210, which are connected, respectively, to an end of the body section 212, and two generally convex curves 214, 216, each located on the other side of the filament cross-section generally opposite one of the illustrated radius of curvatures (Rc).

Figure 19:
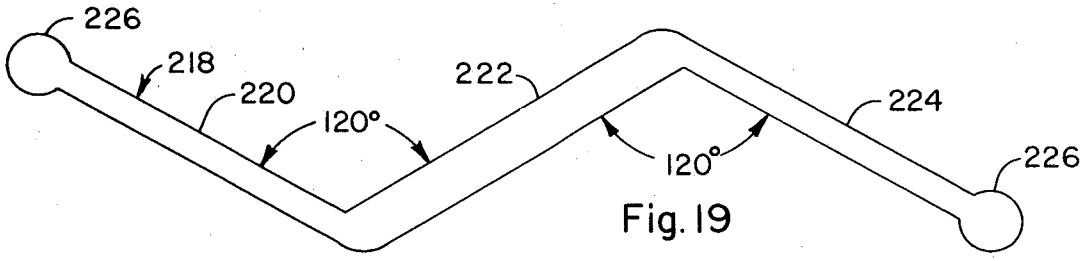
FIG. 19 is a drawing of a spinneret orifice having a single-segment body section and a one-segment wing member intersecting at about 120° at each end of the body section, with each wing member being of the same length as the other.

The spinneret orifice cross-section 218 in FIG. 19 has intersecting quadrilaterals 220, 222, 224 with the single wider intersecting quadrilateral 222 forming a single segment body section and the other single intersecting quadrilaterals 220 and 224 forming two single segment wing members. The angles between the body section and the wing members are each about 120° as illustrated in FIG. 19. The width of the body section is about 1.4W while the width of the wing member quadrilaterals is W. The extremities of the spinneret orifice cross-section are defined by circular bores 226.

Figure 20:
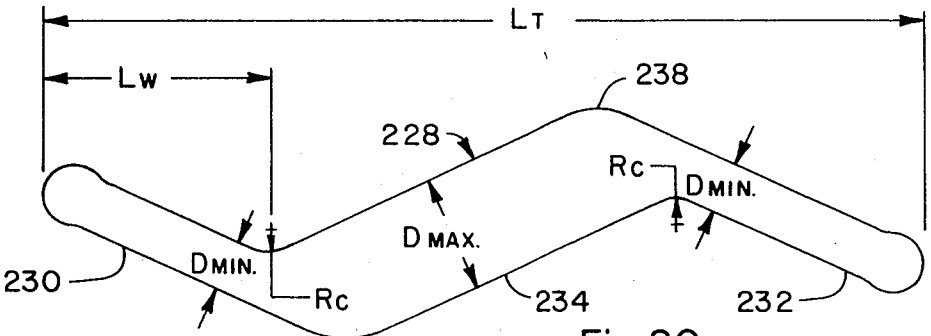
FIG. 20 illustrates the approximate configuration a filament cross-section will have when spun from the spinneret orifice shown in FIG. 19.

FIG. 20 shows the resulting filament cross-section 228, with the filament cross-section having two wing members 230, 232, which are connected, respectively, to an end of the body section 234, and two generally convex curves 236, 238, each located on the other side of the filament cross-section generally opposite one of the illustrated radius of curvatures (Rc).

Figure 21:
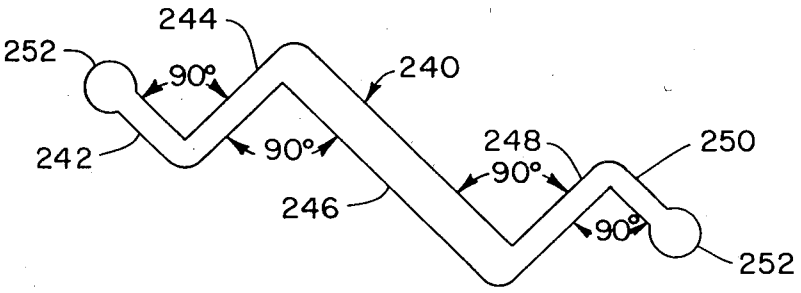
FIG. 21 is a drawing of a spinneret orifice having a single-segment body section and a two-segment wing member intersecting at about 90° with each other and at each end of the body section, with the segments of the wing member at each end of the body section corresponding in length.

The spinneret orifice cross-section 240 in FIG. 21 has intersecting quadrilaterals 242, 244, 246, 248, 250, with the single wider intersecting quadrilateral 246 forming a single segment body section and the other intersecting quadrilaterals 242, 244 and 248, 250 forming two dual segment wing members. The angles between the body section and the wing members are each about 90°, as illustrated in FIG. 21, and the angles between the dual segments of each of the wing members are each about 90°, as also illustrated. The width of the body section is about 1.4W while the width of the wing member quadrilaterals is W. The extremities of the spinneret orifice cross-section are defined by circular bores 252.

Figure 22:
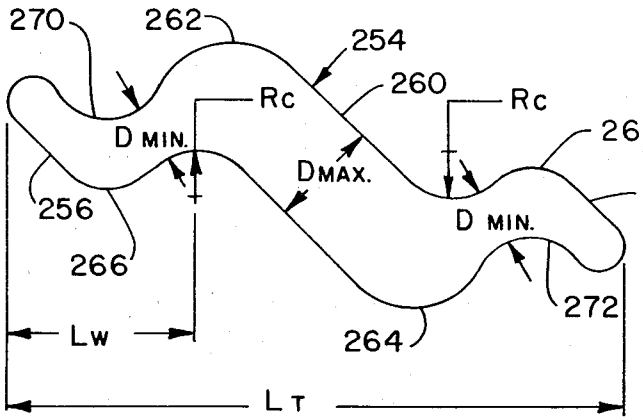
FIG. 22 illustrates the approximate configuration a filament cross-section will have when spun from the spinneret orifice shown in FIG. 21.

FIG. 22 shows the resulting filament cross-section 254, with the filament cross-section having two wing members 256, 258, which are connected, respectively, to an end of the body section 260, and two generally convex curves 262, 264, each located on the other side of the filament cross-section generally opposite one of the illustrated radius of curvatures (Rc).

The dual segmentation of the wing members 256, 258 results in the formation of additional convex curves 266, 268, each of which is located on the other side of the filament cross-section generally opposite, respectively, of concave curves 270, 272. The convex and concave curves mentioned alternate around the periphery of the filament cross-section.

Figure 23:
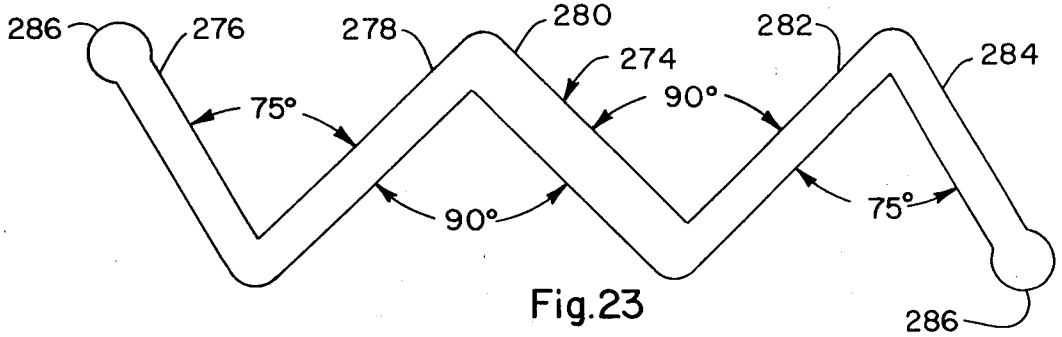
FIG. 23 is a drawing of a spinneret orifice having a single-segment body section and two dual-segment wing members each intersecting with an end of the single-segment body section at about 90° and each segment of the dual-segment wing member intersecting with the other segment at about 75°.

The spinneret orifice cross-section 274 in FIG. 23 has intersecting quadrilaterals 276, 278, 280, 282, 284, with the single wider intersecting quadrilateral 280 forming a single segment body section and the other intersecting quadrilaterals 276, 278 and 282, 284 also forming two dual segment wing members. The angles between the body section and the wing members are each about 90°, as illustrated in FIG. 23, and the angles between the dual segments of each of the wing members are each about 75°, as also illustrated. The width of the body section is about 1.4W while the width of the wing member quadrilaterals is W. The extremities of the spinneret orifice are defined by circular bores 286.

Figure 24:
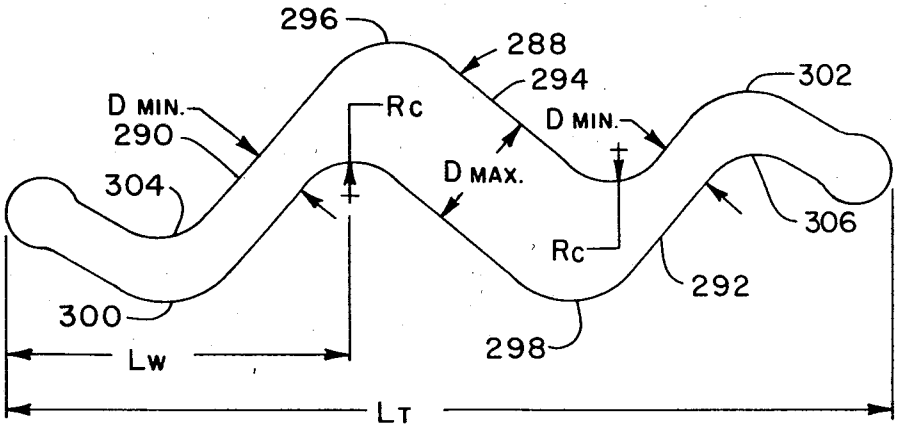
FIG. 24 illustrates the approximate configuration a filament cross-section will have when spun from the spinneret orifice shown in FIG. 23.

FIG. 24 shows the resulting filament cross-section 288, as spun from the spinneret orifice cross-section of FIG. 23, with the filament cross-sections having two wing members 290, 292, which are connected, respectively, to an end of the body section 294, and two generally convex curves 296, 298, each located on the other side of the filament cross-section generally opposite one of the illustrated radius of curvatures (Rc).

The dual segmentation of the wing members 290, 292 also results in the formation of additional convex curves 300, 302, each of which is located on the other side of the filament cross-section generally opposite, respectively, of concave curves 304, 306. The convex and concave curves mentioned alternate around the periphery of the filament cross-section.

Figure 25:
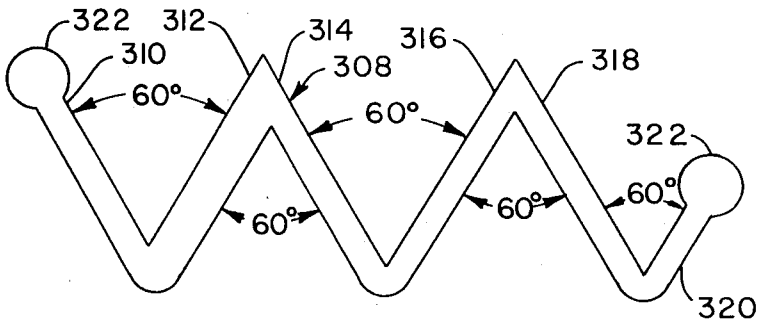
FIG. 25 is a drawing of a spinneret orifice having a single-segment body section and a single-segment wing member intersecting at one end of the single-segment body section at an angle of about 60° and a four-segment wing member intersecting at the other end of the single-segment body section and with each other at an angle of about 60°.

The spinneret orifice cross-section 308 in FIG. 25 has intersecting quadrilaterals 310, 312, 314, 316, 318, 320, with the single wider intersecting quadrilateral 312 forming a single segment body section and the other intersecting quadrilaterals 310 and 314, 316, 318, 320 forming, respectively, a single segment wing member (310) and a four segment wing member (314, 316, 318, 320). The angles between the body section and the wing members are each about 60°, as illustrated in FIG. 25, and the angles between the segments of four segment wing member are each about 60°, as also illustrated. The width of the body section is about 1.4W while the width of the wing member quadrilaterals is W. The extremities of the spinneret orifice are defined by circular bores 322.

Figure 26:
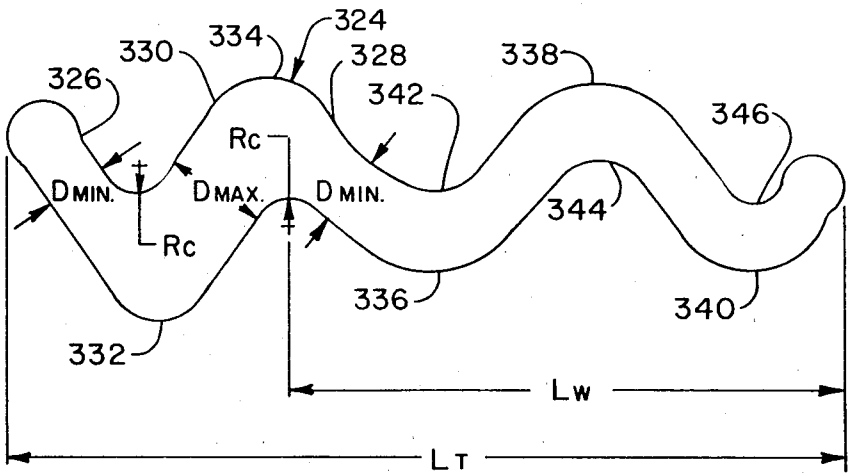
FIG. 26 illustrates the approximate configuration a filament cross-section will have when spun from the spinneret orifice shown in FIG. 25.

FIG. 26 shows the resulting filament cross-section 324, as spun from the spinneret orifice cross-section of FIG. 25, with the filament cross-section having two wing members 326, 328, which are connected, respectively, to an end of the body section 330, and two generally convex curves 332, 334, each located on the other side of the filament cross-section generally opposite one of the ilustrated radius of curvatures (Rc).

The quadri-segmentation of the wing member 328 results in the formation of additional convex curves, each of which is located on the other side of the filament cross-section generally opposite, respectively, of concave curves 342, 344, 346. The convex and concave curves mentioned alternate also around the periphery of the filament cross-section.

Single Wing Member

Figure 27:
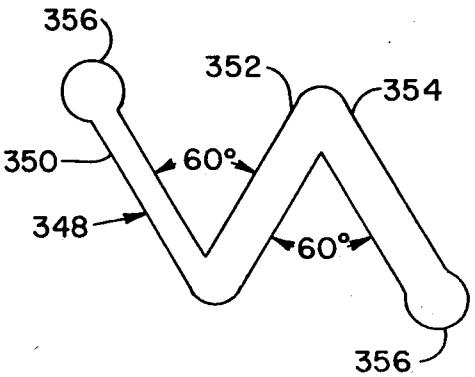
FIG. 27 is a drawing of a spinneret orifice having a dual-segment body section having an angle therebetween of about 60° and having a single-segment wing member intersecting one end of the dual-segment body section at an angle of about 60°.

The spinneret orifice cross-section 348 in FIG. 27 has intersecting quadrilaterals 350, 352, 354, with the two wider intersecting quadrilaterals 352, 354 forming a dual segment body section and the other intersecting quadrilateral 350 forming a single segment wing member. The angle between the body section and the wing member is about 60°, as illustrated in FIG. 27, and the angle between the two segments of the body section is about 60°, as also illustrated. The width of the body section is about 1.4W while the width of the wing member quadrilateral is W. The extremities of the spinneret orifice are defined by circular bores 356.

Figure 28:
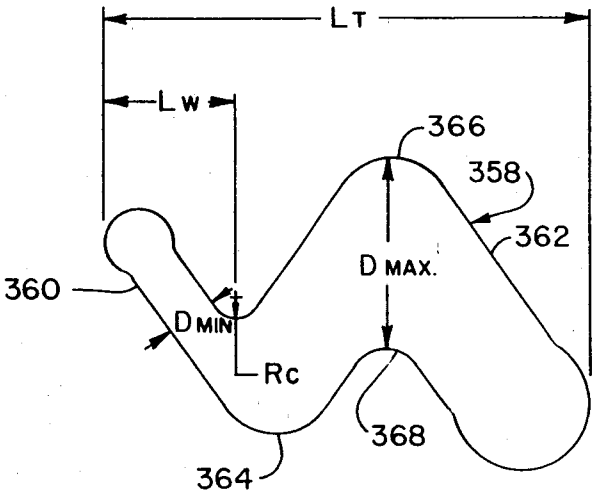
FIG. 28 illustrates the approximate configuration a filament cross-section will have when spun from the spinneret orifice shown in FIG. 27.

FIG. 28 shows the resulting filament cross-section 358, as spun from the spinneret orifice cross-section of FIG. 27, with the filament cross-section having a single segment wing member 360, which is connected to an end of the dual segment body section 362, and one generally convex curve 364 located on the other side of the filament cross-section generally opposite the illustrated radius of curvature (Rc).

The dual segmentation of the body section 362 results in the formation of an additional convex curve or central convex curve 366, which is located on the other side of the filament cross-section generally opposite central concave curve 368. The convex and concave curves also alternate around the periphery of the filament cross-section.

Two Wing Members

Figure 29:
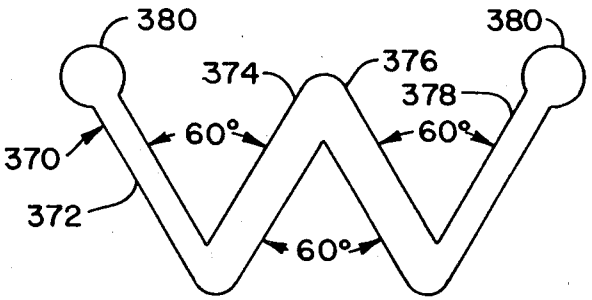
FIG. 29 is a drawing of a spinneret orifice having a dual-segment body section having an angle therebetween of about 60° and having a single-segment wing member intersecting at each end of the dualsegment body section at an angle of about 60°.

The spinneret orifice cross-section 370 in FIG. 29 has intersecting quadrilaterals 372, 374, 376, 378, with the two wider intersecting quadrilaterals 374, 376 forming a dual segment body section and the other intersecting quadrilaterals 372 and 378 forming, respectively, two single segment wing members. The angle between the body section and each wing member is about 60°, as illustrated in FIG. 29, and the angle between the two segments of the body section is about 60°, as also illustrated. The width of the body section is about 1.4W while the width of the wing member quadrilaterals is W. The extremities of the spinneret orifice are defined by circular bores 380.

Figure 30:
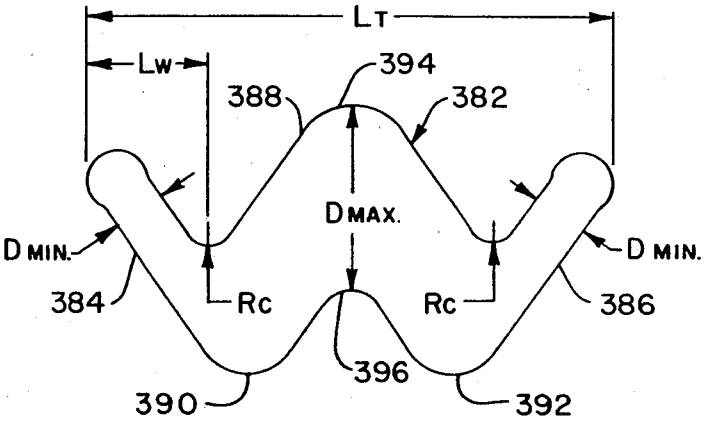
FIG. 30 illustrates the approximate configuration a filament cross-section will have when spun from the spinneret orifice shown in FIG. 29.

FIG. 30 shows the resulting filament cross-section 382, as spun from the spinneret orifice cross-section shown in FIG. 29, with the filament cross-section having two single segment wing members 384, 386, which are connected, respectively, to an end of the body section 388, and two generally convex curves 390, 392, each located on the other side of the filament cross-section generally opposite one of the illustrated radius of curvatures (Rc).

The dual segmentation of the body section 388 also results in the formation of an additional convex curve or central convex curve 394 located on the other side of the filament cross-section generally opposite central concave curve 396. The convex and concave curves mentioned alternate around the periphery of the filament cross-section.

Figure 31:
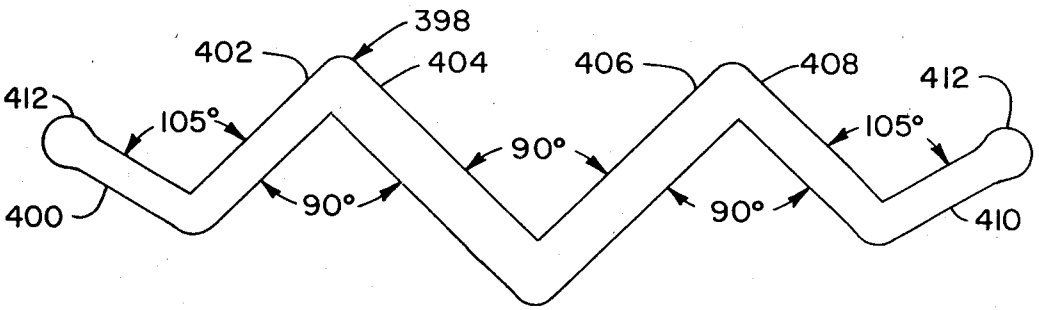
FIG. 31 is a drawing of a spinneret orifice having a dual-segment body section having an angle therebetween of about 90° and having a two-segment wing member intersecting with each other at about 105° and at each end of the dual-segment body section at an angle of about 90°.

The spinneret orifice cross-section 398 in FIG. 31 has intersecting quadrilaterals 400, 402, 404, 406, 408, 410, with the two wider intersecting quadrilaterals 404, 406 forming a dual segment body section and the other intersecting quadrilaterals 400, 402 and 408, 410 forming, respectively, two dual segment wing members. The angle between the body section and each wing member is about 90°, as illustrated in FIG. 31; the angle between the two segments of the body section is about 90°; and the angle between the two segments of each wing member is about 105°. The width of the body section is about 1.4W while the width of the wing member quadrilaterals is W. The extremities of the spinneret orifice are defined by circular bores 412.

Figure 32:
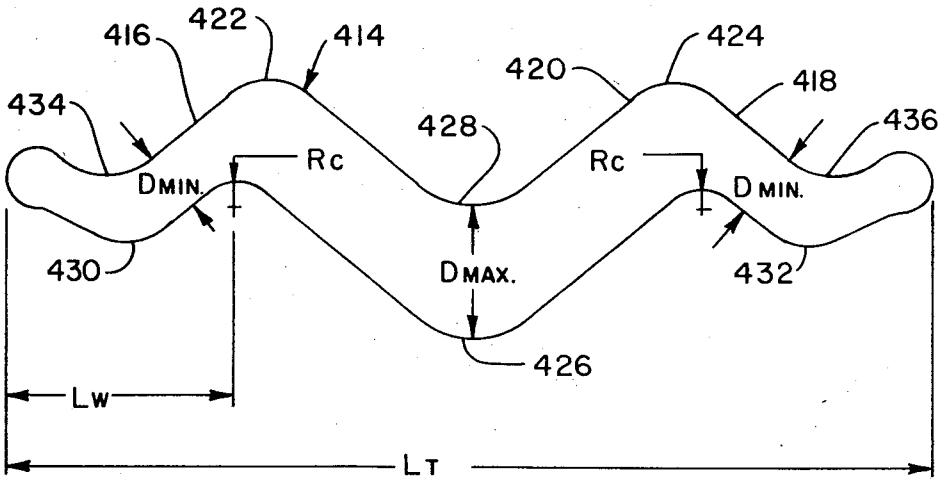
FIG. 32 illustrates the approximate configuration a filament cross-section will have when spun from the spinneret orifice shown in FIG. 31.

FIG. 32 shows the resulting filament cross-section 414, as spun from the spinneret orifice cross-section shown in FIG. 31, with the filament cross-section having two dual segment wing members 416, 418, which are connected, respectively, to an end of the body section 420, and two generally convex curves 422, 424, each located on the other side of the filament cross-section generally opposite one of the illustrated radius of curvatures (Rc).

The dual segmentation of the body section results in the formation of an additional convex curve or central convex curve 426 located on the other side of the filament cross-section generally opposite central concave curve 428; and the dual segmentation of the wing members results in the formation of additional convex curves 430, 432, located on the other side of the filament cross-section generally opposite, respectively, concave curve 434 and concave curve 436. The convex and concave curves mentioned alternate around the periphery of the filament cross-section.

Figure 33:
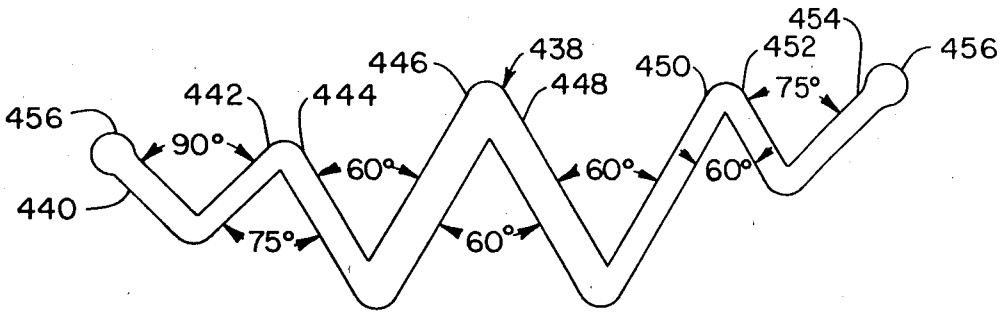
FIG. 33 is a drawing of a spinneret orifice having a dual-segment body section having an angle therebetween of about 60° and having a three-segment wing member, as viewed to the left of the body section, intersecting with each other, respectively, at about 90° and 75° and at one end of the dual-body section at an angle of about 60°, and a second three-segment wing member, as viewed to the right of the body section, intersecting with each other, respectively, at about 75° and about 60° and at the other end of the dual-segment body section at an angle of about 60°, with the lengths of the segments in one wing member differing from those in the other wing member.

The spinneret orifice cross-section 438 in FIG. 33 has intersecting quadrilaterals 440, 442, 444, 446, 448, 450, 452, 454, with the two wider intersecting quadrilaterals 446, 448 forming a dual segment body section and the other intersecting quadrilaterals 440, 442, 446 and 450, 452, 454 forming, respectively, two tri-segment wing members. The angle between the body section and each wing member is about 60°, as illustrated in FIG. 33; the angle between the dual segment body section is about 60°; the angle between intersecting quadrilaterals 442 and 444 is about 75°; the angle between intersecting quadrilaterals 440 and 442 is about 90°; the angle between intersecting quadrilaterals 450 and 452 is about 60°; and the angle between intersecting quadrilaterals 452 and 454 is about 75°. The width of the body section is about 1.4W while the width of the wing member quadrilaterals is W. The extremities of the spinneret orifice are defined by circular bores 456.

Figure 34:
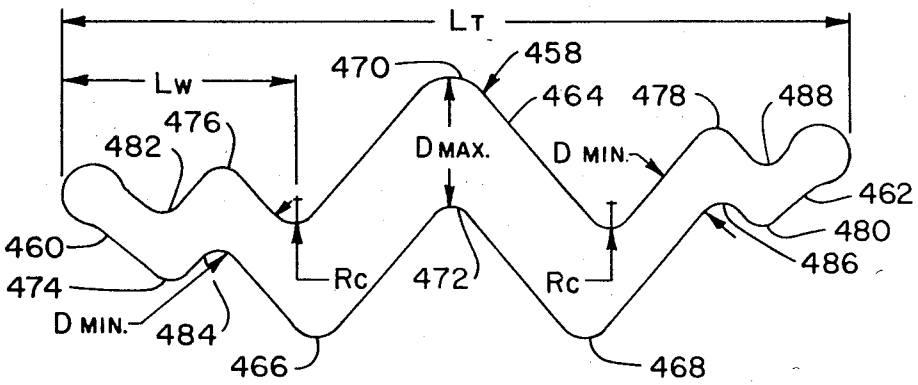
FIG. 34 illustrates the approximate configuration a filament cross-section will have when spun from the spinneret orifice shown in FIG. 33.

FIG. 34 shows the resulting filament cross-section 458, as spun from the spinneret orifice cross-section shown in FIG. 33, with the filament cross-section having two tri-segment wing members 460, 462, which are connected, respectively, to an end of the body section 464, and two generally convex curves 466, 468, each located on the other side of the filament cross-section generally opposite one of the illustrated radius of curvatures (Rc).

The dual segmentation of the body section results in the formation of an additional convex curve or central convex curve 470 located on the other side of the filament cross-section generally opposite central concave curve 472; and the tri-segmentation of the wing members results in the formation of additional convex curves 474, 476, 478, 480 located on the other side of the filament cross-section generally opposite, respectively, concave curves 482, 484, 486, 488. The convex and concave curves mentioned alternate around the periphery of the filament cross-section.

Figure 35:
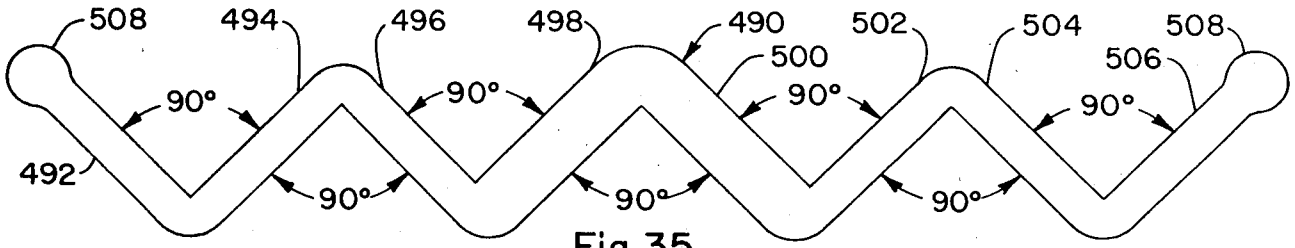
FIG. 35 is a drawing of a spinneret orifice having a dual-segment body section having an angle therebetween of about 90° and having a three-segment wing member intersecting with each other and at each end of the dual-segment body section at about 90°.

The spinneret orifice cross-section 490 in FIG. 35 has intersecting quadrilaterals 492, 494, 496, 498, 500, 502, 504, 506, with the two wider intersecting quadrilaterals 498, 500 forming a dual segment body section and the other intersecting quadrilaterals 492, 494, 496 and 502, 504, 506 forming, respectively, two tri-segment wing members. The angle between the body section and each wing member is about 90°, as illustrated in FIG. 35; the angle between the dual segment body section is about 90°; and the angle between each of the wing member quadrilaterals is about 90°. The width of the body section is about 1.4W while the width of the wing member quadrilaterals is W. The extremities of the spinneret orifice are defined by circular bores 508.

Figure 36:
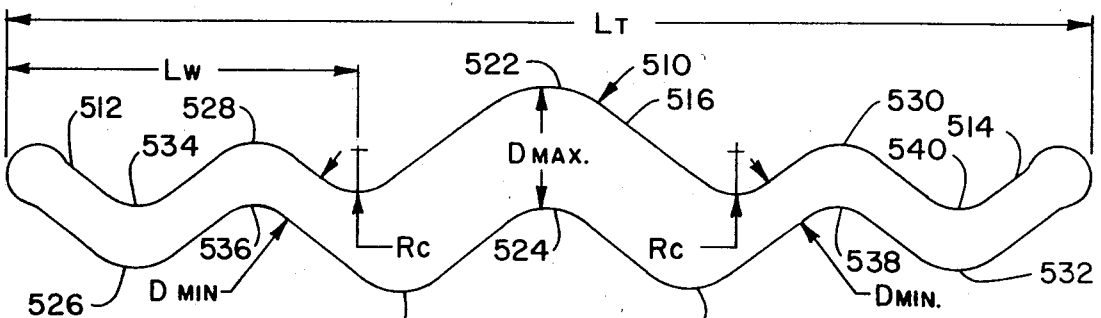
FIG. 36 illustrates the approximate configuration a filament cross-section will have when spun from the spinneret orifice shown in FIG. 35.

FIG. 36 shows the resulting filament 510, as spun from the spinneret orifice cross-section shown in FIG. 35, with the filament cross-section having two tri-segment wing members 512, 514, which are connected, respectively, to an end of the body section 516, and two generally convex curves 518, 520, each located on the other side of the filament cross-section generally opposite one of the illustrated radius of curvatures (Rc).

The dual segmentation of the body section results in the formation of an additional convex curve or central convex curve 522 located on the other side of the filament cross-section generally opposite central concave curve 524; and the tri-segmentation of the wing members results in the formation of additional convex curves 526, 528, 530, 532 located on the other side of the filament cross-section generally opposite, respectively, concave curves 534, 536, 538, 540. The convex and concave curves mentioned alternate around the periphery of the filament cross-section.

Figure 37:
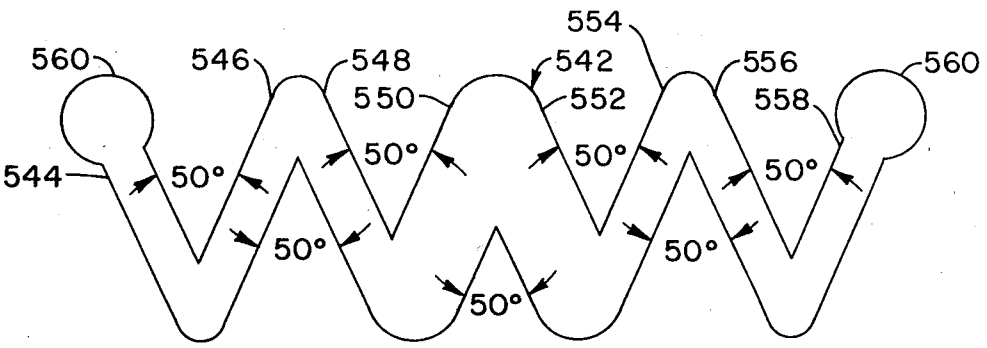
FIG. 37 is a drawing of a spinneret orifice having a dual-segment body section having an angle therebetween of about 50° and having a three-segment wing member intersecting with each other and at each end of the dual-segment body section at about 50°.

The spinneret orifice cross-section 542 in FIG. 37 has intersecting quadrilaterals 544, 546, 548, 550, 552, 554, 556, 558, with the two wider intersecting quadrilaterals 550, 552 forming a dual segment body section and the other intersecting quadrilaterals 544, 546, 548 and 554, 556, 558 forming, respectively, two tri-segment wing members. The angle between the body section and each wing member is about 50°; and the angle between each of the wing member quadrilaterals is about 50°. The width of the body section is about 2W while the width of the wing member quadrilaterals is W. The extremities of the spinneret orifice are defined by circular bores 560.

Figure 38:
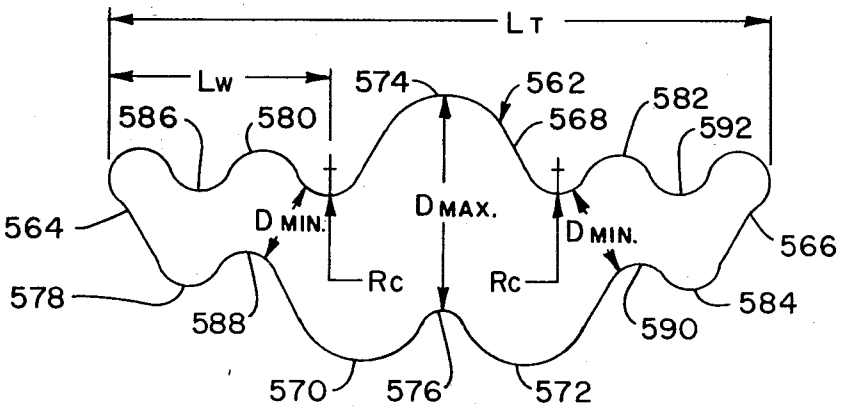
FIG. 38 illustrates the approximate configuration a filament cross-section will have when spun from the spinneret orifice shown in FIG. 37.

FIG. 38 shows the resulting filament cross-section 562, as spun from the spinneret orifice cross-section shown in FIG. 37, with the filament cross-section having two tri-segment wing members 564, 566, which are connected, respectively, to an end of the body section 568, and two generally convex curves 570, 572, each located on the other side of the filament cross-section generally opposite one of the illustrated radius of curvatures (Rc).

The dual segmentation of the body section results in the formation of an additional convex curve or central convex curve 574 located on the other side of the filament cross-section generally opposite central concave curve 576; and the tri-segmentation of the wing members results in the formation of additional convex curves 578, 580, 582, 584 located on the other side of the filament cross-section generally opposite, respectively, concave curves 586, 588, 590, 592. The convex and concave curves mentioned alternate around the periphery of the filament cross-section.

Figure 39:
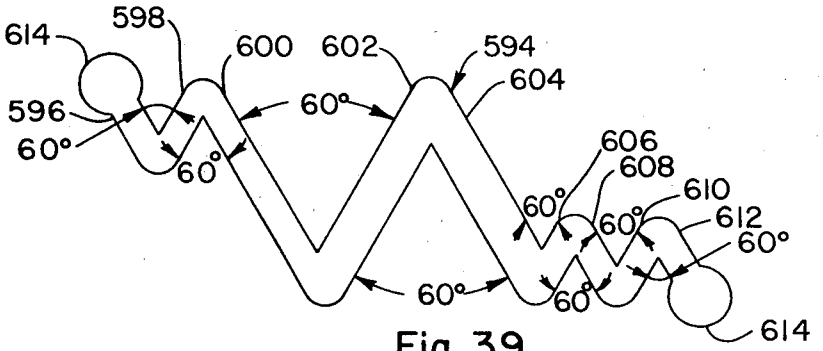
FIG. 39 is a drawing of a spinneret orifice having a dual-segment body section having an angle therebetween of about 60° and having a three-segment wing member, as viewed to the left of the body section, intersecting with each other and at one end of the body section at an angle of about 60°, and having a four-segment wing member, as viewed to the right of the body section, intersecting with each other and at the other end of the body section at an angle of about 60°, with the lengths of the segments in one wing member differing from those in the other wing member.

The spinneret orifice cross-section 594 in FIG. 39 has intersecting quadrilaterals 596, 598, 600, 602, 604, 606, 608, 610, 612, with the two wider intersecting quadrilaterals 602, 604 forming a dual segment body section; intersecting quadrilaterals 596, 598, 600 forming a tri-segment wing member; and intersecting quadrilaterals 606, 608, 610, 612 forming a quadri-segment wing member. The angle between the body section and each wing member is about 60°, as illustrated in FIG. 39; and the angle between each of the segments of the wing members is also about 60°. The width of the body section is about 1.4W while the width of the wing member quadrilaterals is W. The extremities of the spinneret orifice are defined by circular bores 614.

Figure 40:
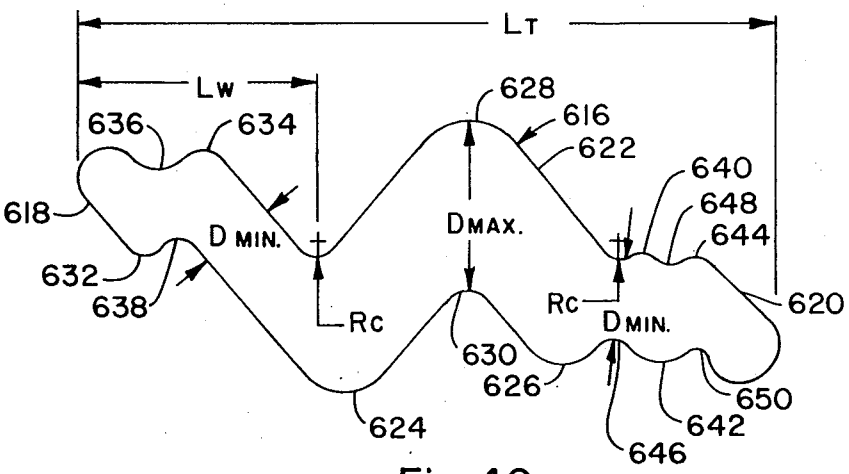
FIG. 40 illustrates the approximate configuration a filament cross-section will have when spun from the spinneret orifice shown in FIG. 39.

FIG. 40 shows the resulting filament cross-section 616, as spun from the spinneret orifice cross-section shown in FIG. 39, with the filament cross-section having a tri-segment wing member 618 and a quadri-segment wing member 620, which are connected, respectively, to an end of the body section 622, and two generally convex curves 624, 626, each located on the other side of the filament cross-section generally opposite one of the illustrated radius of curvatures (Rc).

The dual segmentation of the body section results in the formation of an additional convex curve or central convex curve 628 located on the other side of the filament cross-section generally opposite central concave curve 630; the tri-segmentation of wing member 618 results in the formation of additional convex curves 632, 634 located on the other side of the filament cross-section generally opposite, respectively, concave curves 636, 638; and the quadri-segmentation of wing member 620 results in the formation of additional convex curves 640, 642, 644 located on the other side of the filament cross-section generally opposite, respectively, concave curves 646, 648, 650. The convex and concave curves mentioned alternate around the periphery of the filament cross-section.

Figure 41:
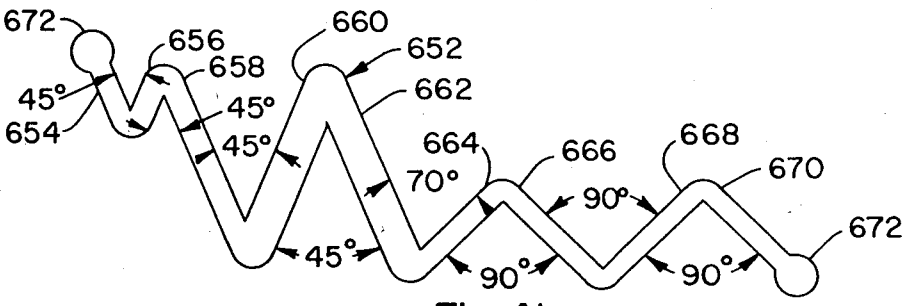
FIG. 41 is a drawing of a spinneret orifice having a dual-segment body section having an angle therebetween of about 45° and having a three-segment wing member, as viewed to the left of the body section, intersecting with each other and at one end of the body section at an angle of about 45°, and having a four-segment wing member, as viewed to the right of the body section, intersecting with each other at an angle of about 90° and at the other end of the body section at an angle of about 70°, with the lengths of the segments in one wing member differing from those in the other wing member.

The spinneret orifice cross-section 652 in FIG. 41 has intersecting quadrilaterals 654, 656, 658, 660, 662, 664, 666, 668, 670, with the two wider intersecting quadrilaterals 660, 662 forming a dual segment body section; intersecting quadrilaterals 654, 656, 658 forming a tri-segment wing member; and intersecting quadrilaterals 664, 666, 668, 670 forming a quadri-segment wing member. The angle between the body section and the tri-segment wing member is about 45°, and the angle between the body section and the quadri-segment wing member is about 70°, as illustrated in FIG. 41; and the angle between each of the segments of the tri-segment wing member is about 45° and the angle between each of the segments of the quadri-segment wing member is about 90°. The width of the body section is about 1.4W while the width of the wing member quadrilaterals is W. The extremities of the spinneret orifice cross-section are defined by circular bores 672.

Figure 42:
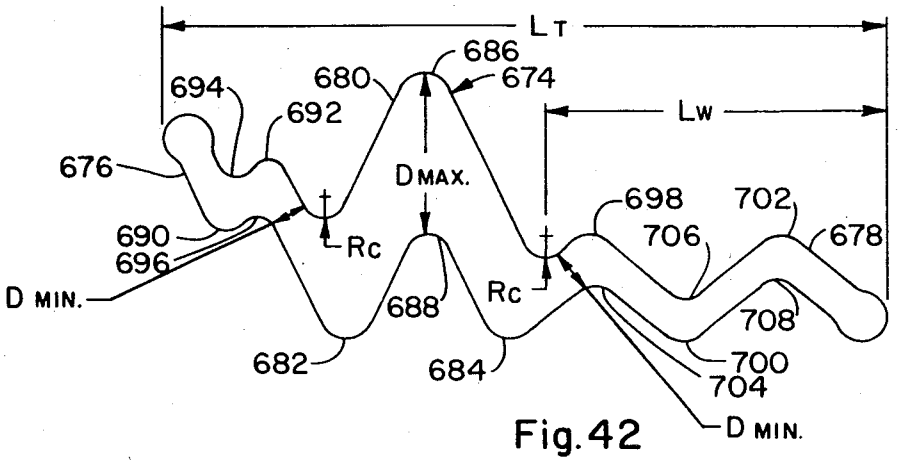
FIG. 42 illustrates the approximate configuration a filament cross-section will have when spun from the spinneret orifice shown in FIG. 41.

FIG. 42 shows the resulting filament cross-section 674, as spun from the spinneret orifice cross-section shown in FIG. 41, with the filament cross-section also having a tri-segment wing member 676 and a quadri-segment wing member 678, which are connected, respectively, to an end of the body section 680, and two generally convex curves 682, 684, each located on the other side of the filament cross-section generally opposite one of the illustrated radius of curvatures (Rc).

The dual segmentation of the body section results in the formation of an additional convex curve or central convex curve 686 located on the other side of the filament cross-section generally opposite central concave curve 688; the tri-segmentation of wing member 676 results in the formation of additional convex curves 690, 692 located on the other side of the filament cross-section generally opposite, respectively, concave curves 694, 696; and the quadri-segmentation of wing member 678 results in the formation of additional convex curves 698, 700, 702 located on the other side of the filament cross-section generally opposite, respectively, concave curves 704, 706, 708. The convex and concave curves mentioned alternate around the periphery of the filament cross-section.

Figure 43:
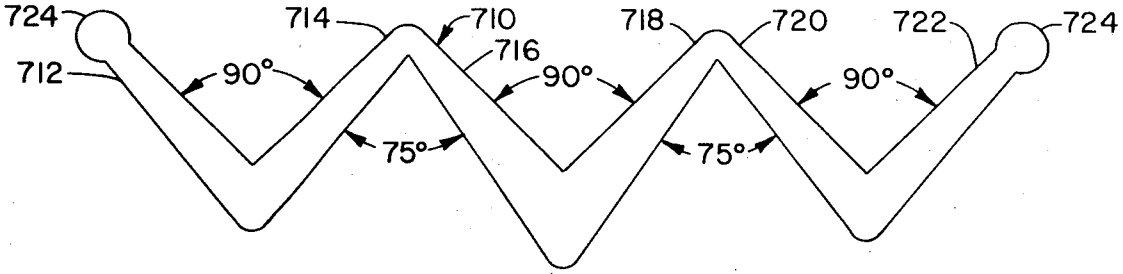
FIG. 43 is a drawing of a spinneret orifice having a tapering dual-segment body section having an angle therebetween of about 90° and having a tapering two-segment wing member intersecting with each other at an angle of about 90° and with the body section at an angle of about 75°.

The spinneret orifice cross-section 710 in FIG. 43 has tapered intersecting quadrilaterals 712, 714, 716, 718, 720, 722, with the two wider tapered intersecting quadrilaterals 716, 718 forming a dual segment body section; and tapered intersecting quadrilaterals 712, 714 and 720, 722 forming, respectively, two dual segment wing members. The angle between the body section and each wing member is about 75°, and the angle between wing member segments is about 90°, as illustrated in FIG. 43. The width of the body section at its widest point is about 1.4W while the width of the wing member quadrilaterals at their corresponding widest point is W. The extremities of the spinneret orifice cross-section are defined by circular bores 724.

Figure 44:
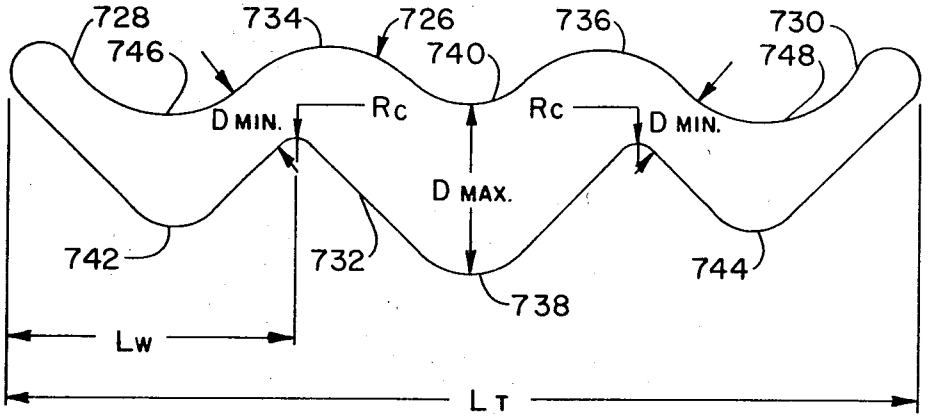
FIG. 44 illustrates the approximate configuration a filament cross-section will have when spun from the spinneret orifice shown in FIG. 43.

FIG. 44 shows the resulting filament cross-section 726, as spun from the spinneret orifice cross-section shown in FIG. 43, with the filament cross-section having, respectively, dual segment wing members 728, 730, which are each connected to an end of the body section 732, and two generally convex curves 734, 736, each located on the other side of the filament cross-section generally opposite one of the illustrated radius of curvatures (Rc).

The dual segmentation of the body section results in the formation of an additional convex curve or central convex curve 738 located on the other side of the filament cross-section generally opposite central concave curve 740; and the dual segmentation of the wing members 728, 730 results in the formation of additional convex curves 742, 744 located on the other side of the filament cross-section generally opposite, respectively, concave curves 746, 748. The convex and concave curves mentioned alternate around the periphery of the filament cross-section.

Single Wing Member

Figure 45:
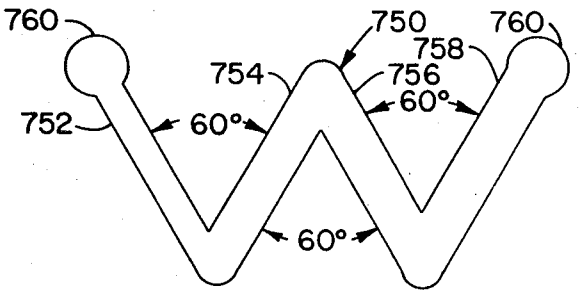
FIG. 45 is a drawing of a spinneret orifice having a three-segment body section intersecting with each other at an angle of about 60° and having a single-segment wing member intersecting at one end of the body section at an angle of about 60°.

The spinneret orifice cross-section 750 in FIG. 45 has intersecting quadrilaterals 752, 754, 756, 758, with the three wider intersecting quadrilaterals 754, 756, 758 forming a tri-segment body section; and intersecting quadrilateral 754 forming a single segment wing member. The angle between the body section and the wing member is about 60°, and the angle between each segment of the body section is about 60°, as illustrated in FIG. 45. The width of the body section is about 1.4W while the width of the wing member is W. The extremities of the spinneret orifice cross-section are defined by circular bores 760.

Figure 46:
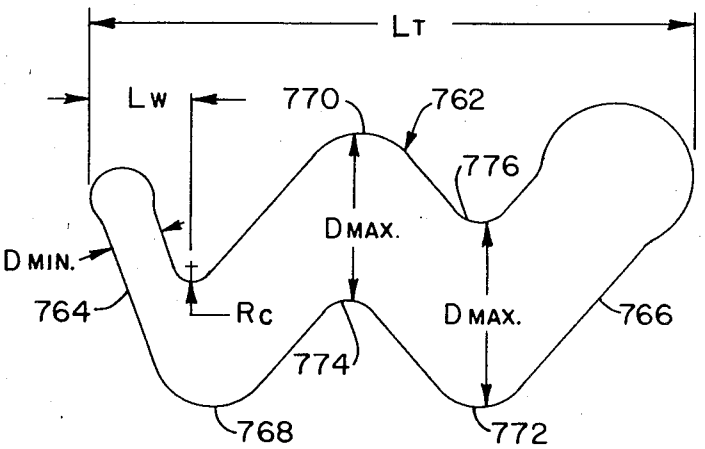
FIG. 46 illustrates the approximate configuration a filament cross-section will have when spun from the spinneret orifice shown in FIG. 45.

FIG. 46 shows the resulting filament cross-section 762, as spun from the spinneret orifice cross-section shown in FIG. 45, with the filament cross-section having a single segment wing member 764 connected to an end of the tri-segment body section 766, and a single generally convex curve 768 located on the other side of the filament cross-section generally opposite the single illustrated radius of curvature (Rc).

The tri-segmentation of the body section results in the formation of additional convex curves or central convex curves 770, 772 located on the other side of the filament cross-section generally opposite, respectively, central concave curves 774, 776. The convex and concave curves mentioned alternate around the periphery of the filament cross-section.

Two Wing Members

Figure 47:
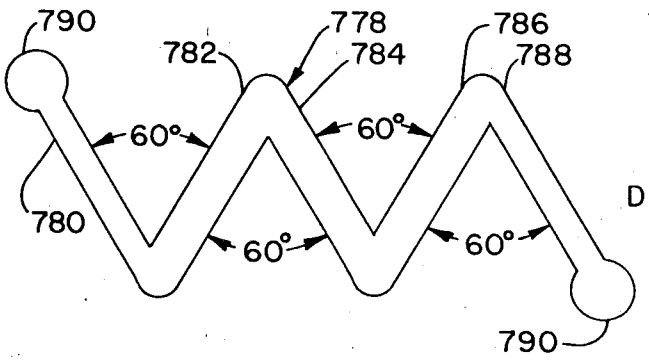
FIG. 47 is a drawing of a spinneret orifice having a three-segment body section intersecting with each other at an angle of about 60° and having a single-segment wing member intersecting at each end of the body section at an angle of about 60°.

The spinneret orifice cross-section 778 in FIG. 47 has intersecting quadrilaterals 780, 782, 784, 786, 788, with the three wider intersecting quadrilaterals 782, 784, 786 forming a tri-segment body section; and intersecting quadrilaterals 780 and 788 forming, respectively, two single segment wing members. The angle between the body section and each wing member is about 60°, and the angle between each segment of the body section is about 60°. The width of the body section is about 1.4W while the width of the wing member quadrilaterals is W. The extremities of the spinneret orifice cross-section are defined by circular bores 790.

Figure 48:
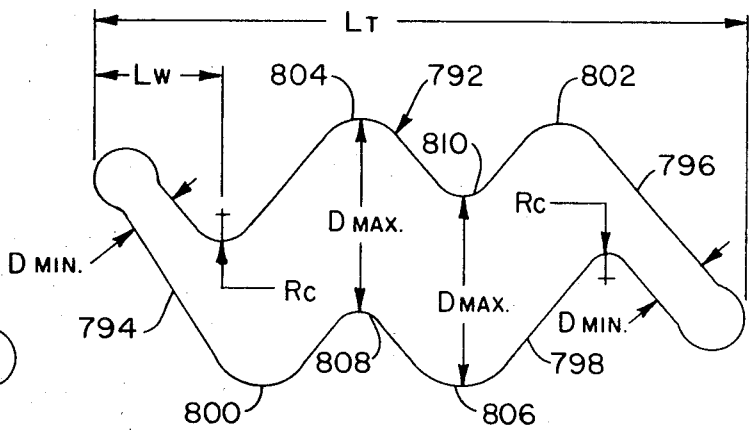
FIG. 48 illustrates the approximate configuration a filament cross-section will have when spun from the spinneret orifice shown in FIG. 49.

FIG. 48 shows the resulting filament cross-section 792, as spun from the spinneret orifice cross-section shown in FIG. 47, with the filament cross-section having single segment wing members 794, 796, which are each connected to an end of the body section 798, and two generally convex curves 800, 802, each located on the other side of the filament cross-section generally opposite one of the illustrated radius of curvatures (Rc).

The tri-segmentation of the body section results in the formation of additional convex curves or central convex curves 804, 806 located on the other side of the filament cross-section generally opposite, respectively, central concave curves 808, 810. The convex and concave curves mentioned alternate around the periphery of the filament cross-section.

Single Wing Member

Figure 49:
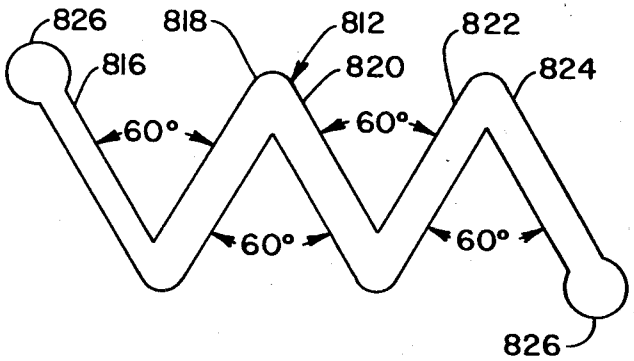
FIG. 49 is a drawing of a spinneret orifice having a four-segment body section intersecting with each other at an angle of about 60° and having a single-segment wing member intersecting at one end of the body section at an angle of about 60°.

The spinneret orifice cross-section 812 in FIG. 49 has intersecting quadrilaterals 816, 818, 820, 822, 824, with the four wider intersecting quadrilaterals 818, 820, 822, 824 forming a quadri-segment body section, and intersecting quadrilateral 816 forming a single segment wing member. The angle between the body section and the single segment wing member is about 60°, and the angle between each of the body section segments is about 60°, as illustrated in FIG. 49. The width of the body section is about 1.4W while the width of the wing member quadrilatral is W. The extremities of the spinneret orifice cross-section are defined by circular bores 826.

Figure 50:
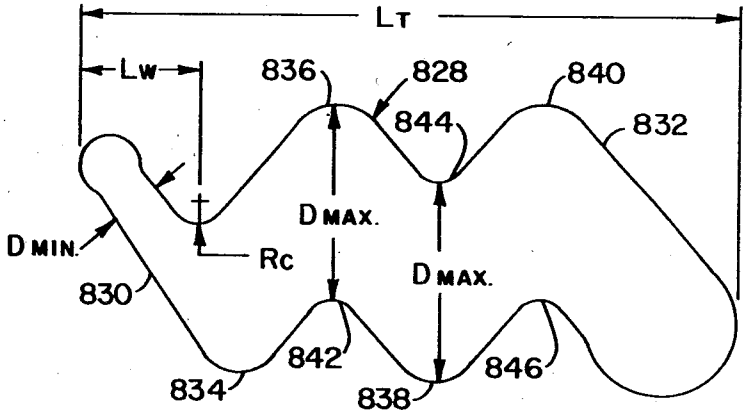
FIG. 50 illustrates the approximate configuration a filament cross-section will have when spun from the spinneret orifice shown in FIG. 50.

FIG. 50 shows the resulting filament cross-section 828, as spun from the spinneret orifice cross-section shown in FIG. 49, with the filament cross-section having a single segment wing member 830 connected to an end of the quadri-segment body section 832, and a single generally convex curve 834 located on the other side of the fiament cross-section generally opposite the illustrated radius of curvature (Rc).

The quadri-segmentation of the body section results in the formation of additional convex curves or central convex curves 836, 838, 840 located on the other side of the filament cross-section generally opposite, respectively, central concave curves 842, 844, 846. The convex and concave curves mentioned alternate around the periphery of the filament cross-section.

Two Wing Members

Figure 51:
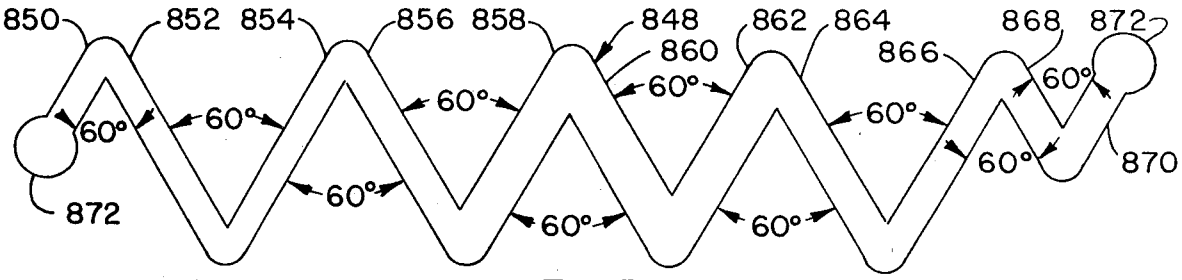
FIG. 51 is a drawing of a spinneret orifice having a three-segment body section intersecting with each other at an angle of about 60° and having two four-segment wing members each intersecting at an end of the body section at an angle of about 60°, and each wing member segment intersecting with another wing member segment also at an angle of about 60°.

The spinneret orifice cross-section 848 in FIG. 51 has intersecting quadrilaterals 850, 852, 854, 856, 858, 860, 862, 864, 866, 868, 870, with the three wider intersecting quadrilaterals 858, 860, 862 forming a tri-segment body section, and intersecting quadrilaterals 850, 852, 854, 856, and 864, 866, 868, 870 forming, respectively, two quadri-segment wing members. The angle between the body section and each wing member is about 60°, and the angle between each wing member segment is also about 60°, as illustrated in FIG. 51. The width of the body section is about 1.4W while the width of the wing members is W. The extremities of the spinneret orifice are defined by circular bores 872.

Figure 52:
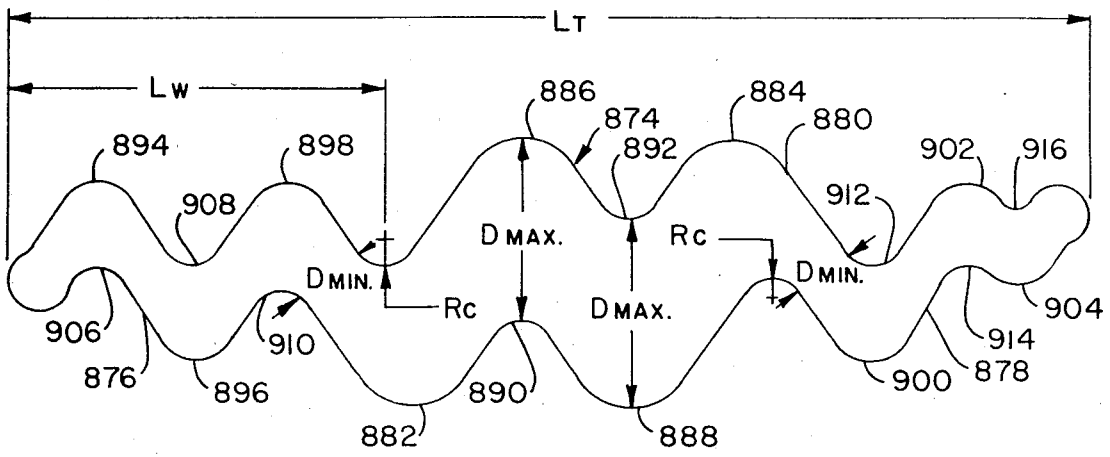
FIG. 52 illustrates the approximate cross-section a filament cross-section will have when spun from the spinneret orifice shown in FIG. 51.

FIG. 52 shows the resulting filament cross-section 874, as spun from the spinneret orifice cross-section shown in FIG. 51, with the filament cross-section having quadri-segment wing members 876, 878 each connected to an end of the tri-segment body section 880, and two generally convex curves 882, 884 located on the other side of the filament cross-section generally opposite one of the illustrated radius of curvatures (Rc).

The tri-segmentation of the body section results in the formation of additional convex curves or central convex curves 886, 888 located on the other side of the filament cross-section generally opposite, respectively, central concave curves 890, 892; and the quadri-segmentation of each of the wing members results in the formation of additional convex curves 894, 896, 898, 900, 902, 904 located on the other side of the filament cross-section generally opposite, respectively, concave curves 906, 908, 910, 912, 914, 916. The convex and concave curves mentioned alternate around the periphery of the filament cross-section.

Figure 53:
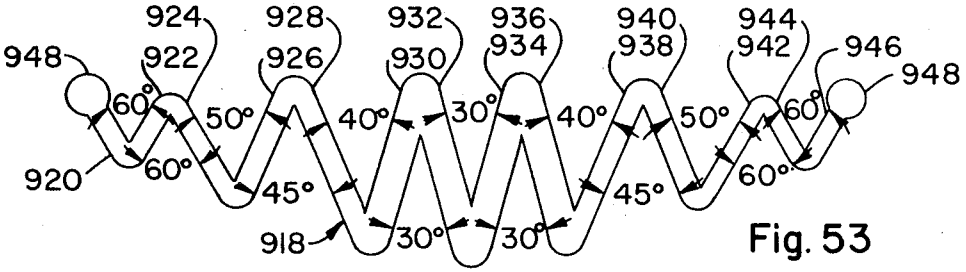
FIG. 53 is a drawing of a spinneret orifice having a four-segment body section intersecting with each other at an angle of about 30° and having two five-segment wing members each intersecting at an end of the body section at an angle of about 40°, and the five segments of each wing member intersecting with each other from the outer end toward the body section, respectively, at angles of about 60°, 60°, 50° and 45°.

The spinneret orifice cross-section 918 in FIG. 53 has intersecting quadrilaterals 920, 922, 924, 926, 928, 930, 932, 934, 936, 938, 940, 942, 944, 946 with the four wider intersecting quadrilaterals 920, 922, 924, 926, 928 and 938, 940, 942, 944, 946 forming respectively, two quinti-segment wing members. The angle between the body section and each wing member is about 40°; the angles between the wing member segments (starting to the left of FIG. 53) for each wing member are, respectively, about 60°, 60°, 50°, 45° and about 45°, 50°, 60°, 60°; and the angles between the body section segments are 30°, as illustrated in FIG. 53. The width of the body section is about 1.4W while the width of the wing members is W. The extremities of the spinneret orifice are defined by circular bores 948.

Figure 54:
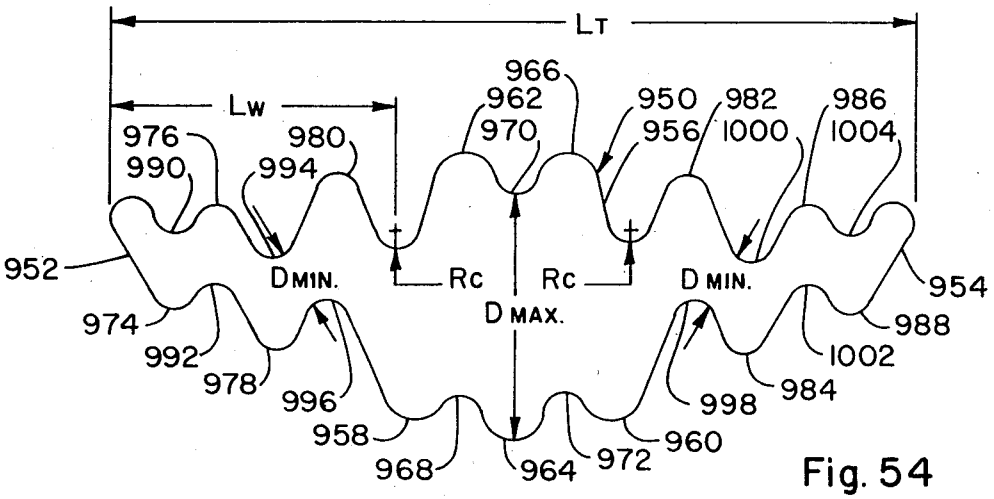
FIG. 54 illustrates the approximate configuration a filament cross-section will have when spun from the spinneret orifice shown in FIG. 53.

FIG. 54 shows the resulting filament cross-section 950, as spun from the spinneret orifice cross-section shown in FIG. 53, with the filament cross-section having quinti-segment wing members 952, 954, each connected to an end of the quadri-segment body section 956, and two generally convex curves 958, 960 located on the other side of the filament cross-section generally opposite one of the illustrated radius of curvatures (Rc).

The quadri-segmentation of the body section results in the formation of additional convex curves or central convex curves 962, 964, 966 located on the other side of the filament cross-section generally opposite, respectively, central concave curves 968, 970, 972; and the quinti-segmentation of each of the wing members results in the formation of additional convex curves 974, 976, 978, 980, 982, 984, 986, 988 located on the other side of the filament cross-section generally opposite, respectively, concave curves 990, 992, 994, 996, 998, 1000, 1002, 1004. The convex and concave curves mentioned alternate around the periphery of the filament cross-section.

Figure 55:
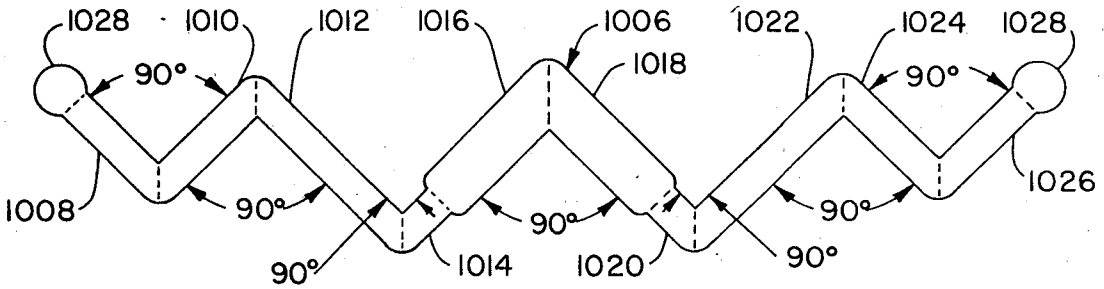
FIG. 55 is a drawing of a spinneret orifice having an enlarged two-segment body section intersecting with each other at an angle of about 90° and having two four-segment wing members each intersecting at each end of the body section at an angle of about 90°, and each wing member segment intersecting with an adjacent wing member segment at an angle of about 90°.

The spinneret orifice cross-section 1006 in FIG. 55 has intersecting quadrilaterals 1008, 1010, 1012, 1014, 1016, 1018, 1020, 1022, 1024, 1026, with the wider intersecting quadrilaterals 1016, 1018 forming a dual segment body section, and intersecting quadrilaterals 1008, 1010, 1012, 1014 and 1020, 1022, 1024, 1026 forming, respectively, two quadri-segment wing members. The angle between the body section and each wing member is about 90°; and the angles between the segments of the wing members are each about 90°, as illustrated in FIG. 55. The width of the body section is about 1.4W while the width of the wing members is W. The extremities of the spinneret orifice are defined by circular bores 1028.

Figure 56:
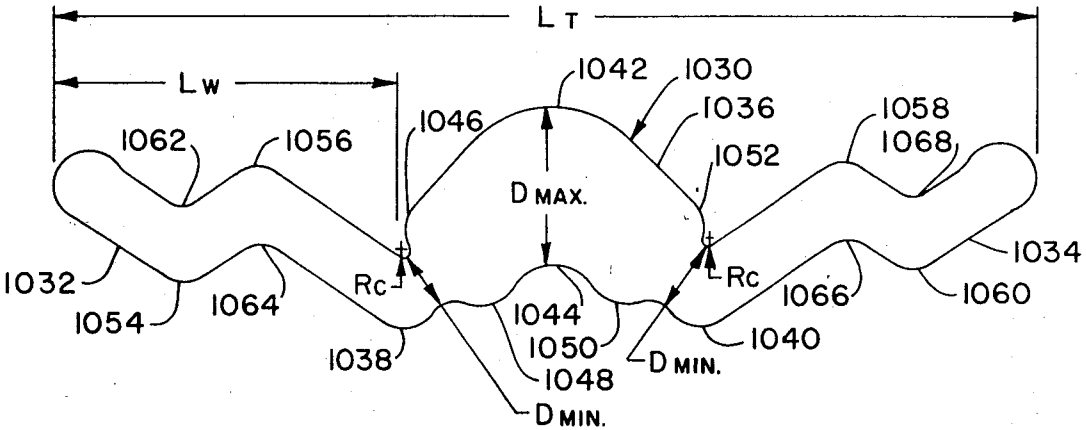
FIG. 56 illustrates the approximate cross-section a filament cross-section will have when spun from the spinneret orifice shown in FIG. 55.

FIG. 56 shows the resulting filament cross-section 1030, as spun from the spinneret orifice cross-section shown in FIG. 55, with the filament cross-section having quadri-segment wing members 1032, 1034, each connected to an end of the dual segment body section 1036, and two generally convex curves 1038, 1040 located on the other side of the filament cross-section generally opposite one of the illustrated radius of curvatures (Rc).

The dual segmentation of the body section results in the formation of an additional convex curve or central convex curve 1042 located on the other side of the filament cross-section generally opposite concave curve 1044, and the shouldered formation of the body section adjacent the connection of each wing member results in the formation of further additional convex curves 1046, 1048 and 1050, 1052, as illustrated in FIG. 56. As further illustrated, the quadri-segmentation of the wing members results in the formation of additional convex curves 1054, 1056, 1058, 1060 located on the other side of the filament cross-section generally opposite, respectively, concave curves 1062, 1064, 1066, 1068. The convex and concave curves mentioned alternate around the periphery of the filament cross-section.

Four Wing Members

Figure 57:
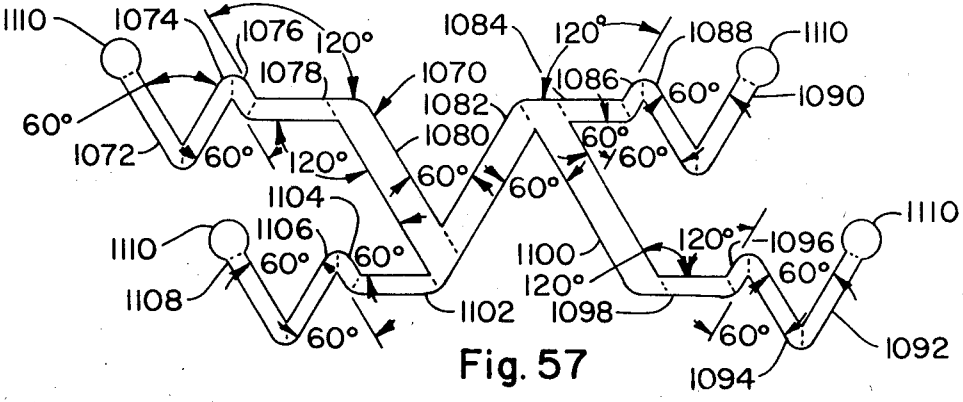
FIG. 57 is a drawing of a spinneret orifice having a three-segment body section intersecting with each other at an angle of about 60° and four wing members, each, for instance, being in four segments and the segments intersecting with each other at an angle of about 60° with two diagonally opposite wing members intersecting the body section at an angle of about 120° and the other diagonally opposite two wing members intersecting the body section at an angle of about 60°.

The spinneret orifice cross-section 1070 in FIG. 57 has intersecting quadrilaterals 1072, 1074, 1076, 1078, 1080, 1082, 1084, 1086, 1088, 1090, 1092, 1094, 1096, 1098, 1100, 1102, 1104, 1106, 1108. The three wider intersecting quadrilaterals 1080, 1082, 1100 form a tri-segment body section. Intersecting quadrilaterals 1071, 1073, 1076, 1078; 1084, 1086, 1088, 1090; 1092, 1094, 1096, 1098; and 1102, 1104, 1106, 1108 form, respectively, first, second, third, fourth or four quadri-segment wing members. The angle between the body section and each of the first and third wing members is about 120°, and the angle between the body section and each of the second and fourth wing members is about 60°, as illustrated in FIG. 57. The angle between each of the body section segments is about 60°; and the angles between the segments of each wing member are from the body section toward the outer extremity, respectively, about 120°, 60°, and 60°. The width of the body section is about 1.4W while the width of the wing members is W. The extremities of the spinneret orifice are defined by circular bores 1110.

Figure 58:
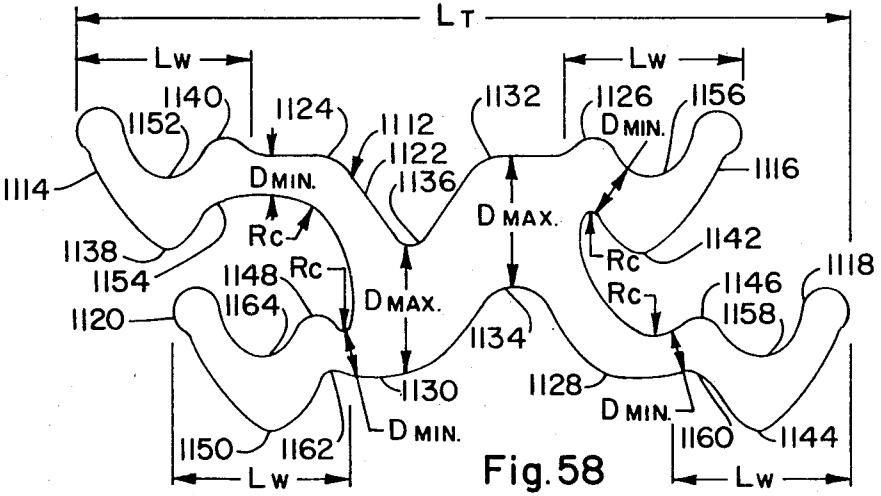
FIG. 58 illustrates the approximate cross-section a filament cross-section will have when spun from the spinneret orifice shown in FIG. 57.

FIG. 58 shows the resulting filament cross-section 1112, as spun from the spinneret orifice cross-section shown in FIG. 57, with the filament cross-section having quadri-segment wing members 1114, 1116, 1118, 1120, each connected to an end of the tri-segment body section 1122, and four generally convex curves 1124, 1126, 1128, 1130 located on the other side of the filament cross-section generally opposite one of the illustrated radius of curvatures (Rc).

The tri-segmentation of the body section results in the formation of an additional convex curve or central convex curve 1132 located on the other side of the filament cross-section generally opposite central concave curve 1134. There is at least one other concave or central concave curve 1136 which is offset from the other central concave curve, but the convex curve opposite it blends into and with the previously identified convex curve 1130 so that it becomes a matter of choice whether to separately identify it or the convex portion and the latter has already been identified as convex curve 1130 which is located generally opposite one of the radius of curvatures (Rc). The quadri-segmentation of each of the wing members results in the formation of additonal convex curves 1138, 1140, 1142, 1144, 1146, 1148, 1150 located on the other side of the filament cross-section generally opposite, respectively, concave curves 1152, 1154 [which blends into and with the adjacent radius of curvature (Rc)], 1156, 1158, 1160, 1162, 1164. The convex and concave curves mentioned alternate around the periphery of the filament cross-section.

The invention will be further illustrated by the following examples, although it will be understood that these examples are included merely for purposes of illustration and are not intended to limit the scope of the invention.

EXAMPLE 1

The filaments shown in FIGS. 4, 6 and 8 were made using the following equipment and process conditions, which are typical for polyester partially oriented yarn (POY).

The basic unit of this spinning system design can be subdivided into an extrusion section, a spin block section, a quench section and a take-up section. A brief description of these sections follows.

The extrusion section of the system consists of a vertically mounted screw extruder with a 28:1 L/D screw 2-½ inches in diameter. The extruder is fed from a hopper containing polymer whih has been dried in a previous separate drying operation to a moisture level ≦0.003 weight percent. Pellet poly(ethylene terephthalate) (PET) polymer (0.64 I.V.) containing 0.3% $TiO_2$ and 0.9% diethylene glycol (DEG) enters the feed port of the screw where it is heated and melted as it is conveyed vertically downward. The extruder has four heating zones of about equal length which are controlled, starting at the feed end at a temperature of 280, 285, 285, 280. These temperatures are measured by platinum resistance temperature sensors Model No. 1847-6-1 manufactured by Weed. The rotational speed of the screw is controlled to maintain a constant pressure in the melt (~2100 psi) as it exits from the screw into the spin block. The pressure is measured by use of an electronic pressure transmitter [Taylor Model 1347.TF11334(158)]. The temperature at the entrance to the block is measured by a platinum resistance temperature sensor Model No. 1847-6-1 manufactured by Weed.

The spin block of the system consists of a 304 stainless steel shell containing a distribution system for conveying the polymer melt from the exit of the screw extruder to eight dual position spin packs. The stainless steel shell is filled with a Dowtherm liquid/vapor system for maintaining precise temperature control of the polymer melt at the desired spinning temperature of 280° C. The temperature of the Dowtherm liquid/vapor system is controlled by sensing the vapor temperature and using this signal to control the external Dowtherm heater. The Dowtherm liquid temperature is sensed but is not used for control purposes.

Mounted in the block above each dual position pack are two gear pumps. These pumps meter the melt flow into the spin pack assemblies and their speed is precisely maintained by an inverter controlled drive system. The spin pack assembly consists of a flanged cylindrical stainless steel housing (198 mm. in diameter, 102 mm. high) containing two circular cavities of 78 mm. inside diameter. In the bottom of each cavity, a spinneret, having spinneret orifice cross-sections such as shown in either FIG. 3, FIG. 5 or FIG. 7, is placed following by 300 mesh circular screen, and a breaker plate for flow distribution. Above the breaker plate is located a 300 mesh screen followed by a 200 mm. bed of sand (e.g., 20/40 to 80/100 mesh layers) for filtration. A stainless steel top with an entry port is provided for each cavity.

The spin pack assemblies are bolted to the block using an aluminum gasket to obtain a no-leak seal. The pressure and temperature of the polymer melt are measured at the entrance to the pack (126 mm. above the spinneret exit).

The quench section of the melt spinning system is described in U.S. Pat. No. 3,669,584. The quench section consists of a delayed quench zone near the spinneret separated from the main quench cabinet by a removable shutter with circular openings for passage of the yarn bundle. The delayed quench zone extends to approximately 2-3/16" below the spinneret. Below the shutter is a quench cabinet provided with means for applying force convected cross-flow air to the cooling and attenuating filaments. The quench cabinet is approximately 40-½" tall by 10-½" wide by 14-½" deep. Cross-flow air enters from the rear of the quench cabinet at a rate of 160 SCFM. The quench air is conditioned to maintain constant temperature at 77°±2° F. and humidity is held constant as measured by dew point at 64°±2° F. The quench cabinet is open to the spinning area on the front side. To the bottom of the quench cabinet is connected a quench tube which has an expanded end near the quench cabinet but narrows to dual rectangular sections with rounded ends (each approximately 6-⅜"×15-¾"). The quench tube plus cabinet is 16 feet in length. Air temperatures in the quench section are plotted as a function of distance from the spinneret in FIG. 19 of U.S. Pat. No. 4,245,001.

The take-up section of the melt spinning system consists of dual ceramic kiss roll lubricant applicators, two Godet rolls and a parallel package winder (Barmag SW4). The yarn is guided from the exit of the quench tube across the lubricant rolls. The RPM of the lubricant rolls is set at 32 RPM to achieve the desired level of one percent lubricant on the asspun yarn. The lubricant is composed of 95 weight percent UCON-50HB-5100 (ethoxylated propoxylated butyl alcohol [viscosity 5100 Saybolt sec]), 2 weight percent sodium dodecylbenzene sulfonate and 3 weight percent POE5 lauryl potassium phosphate. From the lubricant applicators the yarn passes under the bottom half of the pull-out Godet and over the top half of the second Godet, both operating at a surface speed of 3014 meters per minute and thence to the winder. The Godet rolls are 0.5 m. in circumference and their speed is inverter controlled. The drive roll of the surface-driven winder (Barmag) is set such that the yarn tension between the last Godet roll and the winder is maintained at 0.1 to 0.2 grams per denier. The traverse speed of the winder is adjusted to achieve an acceptable package build. The as-spun yarn is wound on paper tubes which are 75 mm. inside diameter by 290 mm. long.

The filaments spun by the procedure set forth in Example 1 were draw-fractured to manufacture yarn. The drawing equipment is followed by an air-jet fracturing unit. The apparatus features a pretension zone and drawing zone, a heated feed roll, and electrically heated stabilization plates or a slit heater. The apparatus also incorporates a pinch roll at the feed Godet as shown in U.S. Pat. No. 3,539,680. In operation of the system the as-spun package is placed in the creel. The as-spun yarn is threaded around a pretension Godet and then six times around a heated feed roll. The feed roll/pretension speed ratio is maintained at 1.005. From the feed roll the yarn exits under the pinch roll and passes across the stabilization plate or slit heater to the draw roll where it is wrapped six times. The draw roll/feed roll speed ratio is selected based on the denier of the as-spun yarn and the desired final denier and the orientation characteristics of the as-spun yarn. The feed roll temperature was set at 83° C. However, for this yarn 105° C. is preferred. The stabilization plate temperature was set at 180° C. (this value may be varied from ambient temperature to 210° C.). For drafting only the yarn is passed from the draw roll to a parallel package winder (Leesona Model 959). For fracturing, the yarn passes from the draw roll through a fracturing air jet to be described below, adjusted to a blowback of 2 psig., and onto a forwarding Godet roll. The forwarding Godet roll is operating at a speed of 99.5% of that of the draw roll to provide a 0.5% overfeed through the fracturing jet.

The preferred fracturing jet design is a jet using high pressure gaseous fluid to fracture the wings from the filament body and to entangle the filaments making up the yarn bundle as well as distributing uniformly the protruding ends formed by the fracturing operation throughout the yarn bundle and along the surface of the yarn bundle. The yarn is usually overfed slightly through the jet from 0.05% to 5% with 0.5% being especially desirable.

A particularly useful fracturing jet (herein called the Nelson jet) is that disclosed in U.S. Pat. No. 4,095,319. The description is incorporated herein by reference. In FIG. 2 of the patent there is shown a cross-sectional view in elevation of this jet which I prefer for the fracturing of my novel filaments. This jet comprises an elongated housing 12' capable of withstanding pressures of 300 to 500 psig., the housing is provided with a central bore 14', which also defines in part a plenum chamber for receiving therein a gaseous fluid. A venturi 16' is supported in the central bore in the exit end of the housing and has a passageway extending through the venturi with a central entry opening 18', a converging wall portion 20', a constant diametered throat 22' with a length nearly the same as the diameter, a diverging wall portion 24' and a central exit opening 26'.

An orifice plate 28' is supported in the central bore and abuts against the inner end of the venturi in the manner shown. The orifice plate has a central opening 30' which is concentric with the central entry opening of the venturi, and the wall 32' of the entry opening has an inwardly tapering bevel terminating in an exit opening 34'. A yarn guiding needle 36' is also positioned in the central bore of the housing and has an inner end portion 38' spaced closely adjacent the central entry opening of the orifice plate. The needle has an axial yarn guiding passageway 40' which extends through the needle and terminates in an exit opening 42'. The outer wall of the inner end portion of the needle adjacent the exit opening is inwardly tapered toward the orifice plate in the manner shown. An inlet or conduit 44' serves to introduce the gaseous treating fluid, such as air, into the plenum chamber of the central bore 14' of the housing 12'.

The inward taper of the outer wall of the needle inner end portion 38' is about 15° relative to the axis of the axial yarn guiding passageway 40'. The needle exit opening has a diameter of about 0.025 inch. The wall of the central entry opening 30' of the orifice plate 28' has an inwardly tapering bevel of about 30° relative to the axis of the entry opening 32', the exit opening 34' has a diameter of about 0.031 inch, and the length of such exit opening is about 0.010 inch. The thickness of the orifice plate is about 0.063 inch.

The constant diametered throat 22' of the venturi 16' extends inwardly from the central entry opening 18' by a distance of about 0.094 inch; the throat has a length of about 0.031 inch and a diameter of about 0.033 inch. The converging wall portion 20' of the venturi has an angle of about 17.5° relative to the axis of the central entry opening of the venturi and the venturi central entry opening has a diameter of about 0.062 inch.

A holder 52 aids in holding the venturi in positon in addition to the corresponding use of the threaded plug 50' while an O-ring 54 provides a gas-tight seal in a known manner with the holder to prevent gas from escaping from the plenum chamber.

The yarn guiding needle 36' is adjustably spaced within the central bore 14' from the orifice plate 28' by means of the threaded member 56. The needle is secured to the threaded member by means of cooperating grooves and retaining rings 58. O-ring 60 serves as a gas seal in known manner. Rotation of the threaded member 56 serves to adjust the spacing of the needle relative to the orifice plate 28'.

In using the jet it is adjusted to give a blowback of 2 psig. as determined by the following procedure. A constant 20 psig. air source is attached to the air inlet of the jet by a rubber hose. The yarn inlet of the jet is pressed and sealed against a pressure gauge. The threaded member 56 is adjusted until 2 psig. is obtained on the pressure gauge. This jet is said to be adjusted to a blowback of 2 psig.

The following examples concern the filament cross-sections disclosed, respectively, in FIGS. 4, 6 and 8.

EXAMPLE A

1. Spinneret has 25 holes each having a spinneret orifice cross-section as illustrated in FIG. 3. W=84 microns
2. Extrusion Conditions
   Polymer: poly(ethylene terephthalate)
   I.V.: 0.62, 0.3% $TiO_2$
   Melt temperature: 285° C.
   As-spun denier: 260
   Lubricant: (see EXAMPLE 1)
   Quench: (see EXAMPLE 1)
   Take-up speed: 3014 meters/minute
   170 denier/25 filaments
3. Drafting and Fracturing Conditions
   Draw Ratio: 1.55X
   Feed roll temperature: 90° C.
   Slit heaters (2): 240° C.
   Speed: 600 meters/minute (1% overfeed)
   Fracture jets (2): pressure: 500 psi. (6.5 scfm/jet)
4. Fractured Yarn Properties
   Tenacity: 2.6 grams/denier
   Elongation: 22%
   Modulus: 61 grams/denier
   Boiling water shrinkage: 6.3%
   Sp. vol. @0.1 G/D tension: 2.00 cc./gm.
   Laser |b|: 0.57
   Laser |a/b|: 578
   Laser L+7: 9

EXAMPLE B

1. Spinneret has 30 holes, each having a spinneret orifice cross-section as illustrated in FIG. 5. W=84 microns
2. Extrusion Conditions
   Same as EXAMPLE A except 170 denier/30 filaments.
3. Drafting and Fracturing Conditions
   Draw ratio: 1.50X
   Feed roll temperature: 95° C.
   Slit heaters (2): 240° C.
   Speed: 800 meters/minute (1% overfeed)
   Fracture jets (2): pressure: 500 psi. (6.5 scfm/jet)
4. Fractured Yarn Properties
   Tenacity: 2.1 grams/denier
   Elongation: 18%
   Modulus: 40 grams/denier
   Boiling water shrinkage: 10%
   Sp. vol. @0.1 G/D tension: 1.85 cc./gm.
   Laser |b|: 0.65
   Laser |a/b|: 425
   Laser L+7: 9
   % Wing member(s): 23
   % Body sections: 77

EXAMPLE C

1. Spinneret has 30 holes, each having a spinneret orifice cross-section as illustrated in FIG. 7. W=84 microns.
2. Extrusion Conditions
   Same as EXAMPLE A except 170 denier/30 filaments
3. Drafting and Fracturing Conditions
   Draw ratio: 1.48X
   Feed roll temperature: 85° C.
   Slit heaters (2): 240° C.
   Speed: 800 meters/minute (3% overfeed)
   Fracture jets (2): pressure: 500 psi (6.5 scfm/jet)
4. Fractured Yarn Properties
   Tenacity: 1.7 grams/denier
   Elongation: 14%
   Modulus: 39 grams/denier
   Boiling water shrinkage: 8%
   Sp. vol. @0.1 G/D tension: 2.22 cc./gm.
   Laser |b|: 0.62
   Laser |a/b|: 833
   Laser L+7: 4
   % Wing member(s): 44
   % Body section: 56

Fractured Filaments

Figure 59:
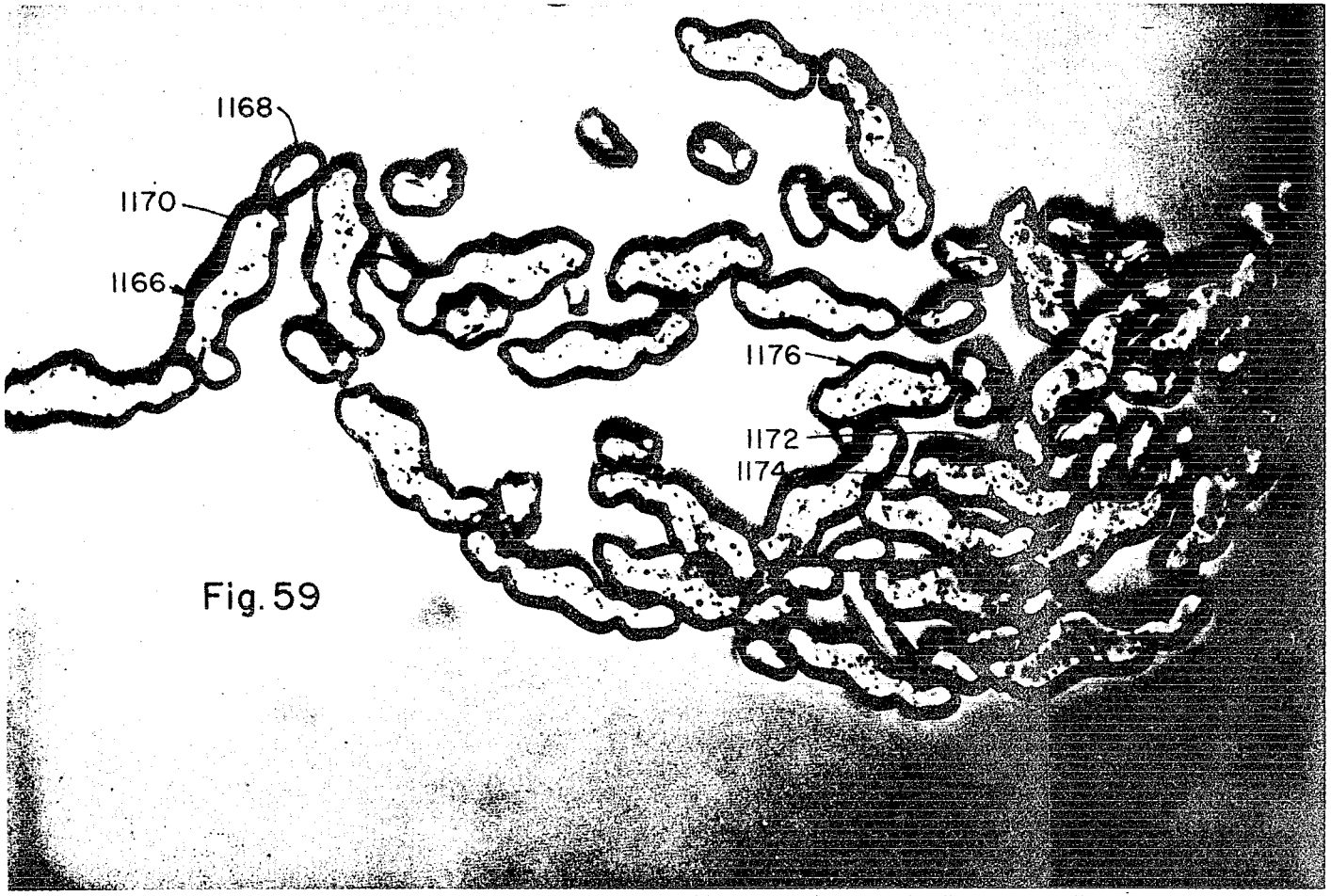
FIG. 59 is a photomicrograph of fractured and nonfractured filament cross-sections.

In reference to FIG. 59, the photomicrograph shows fractured and non-fractured filament cross-sections to give a better idea of the locations where fractures occur. Fractures generally occur at the radius of curvature (Rc) where the wing members intersect with the body section. Filament cross-section is an example of one such fractured filament cross-section showing one of the wing members 1168 having been fractured or separated from the body section 1170.

Because of the undulatory type surface of the wing members, fracturing may occur at locations away from the intersections of the body section and wing members, as shown by filament cross-section 1172 where a portion of one wing member has been fractured and is shown as missing at 1174. This secondary fracturing, however, usually is a small percentage of the total amount of fracturing observed.

Filament cross-section 1176 in FIG. 59 is an example of a filament cross-section where both wing members have fractured from the body section.

Discussion of Free Protruding Ends Formed in Yarns Upon Being Fractured

It has been noted from an inspection of yarns comprising filament cross-sections of the present invention and of those comprising filament cross-sections disclosed in the aforementioned U.S. Pat. No. 4,245,001, that a typical yarn will have many free protruding ends distributed along the surface and throughout the yarn bundle. As mentioned in U.S. Pat. No. 4,245,001, the yarn is coherent due to the entangling and intermingling of neighboring fibers. These free protruding ends are formed as the feed yarn is fed through a fracturing jet as is shown in FIG. 20 of the patent.

Figure 60:
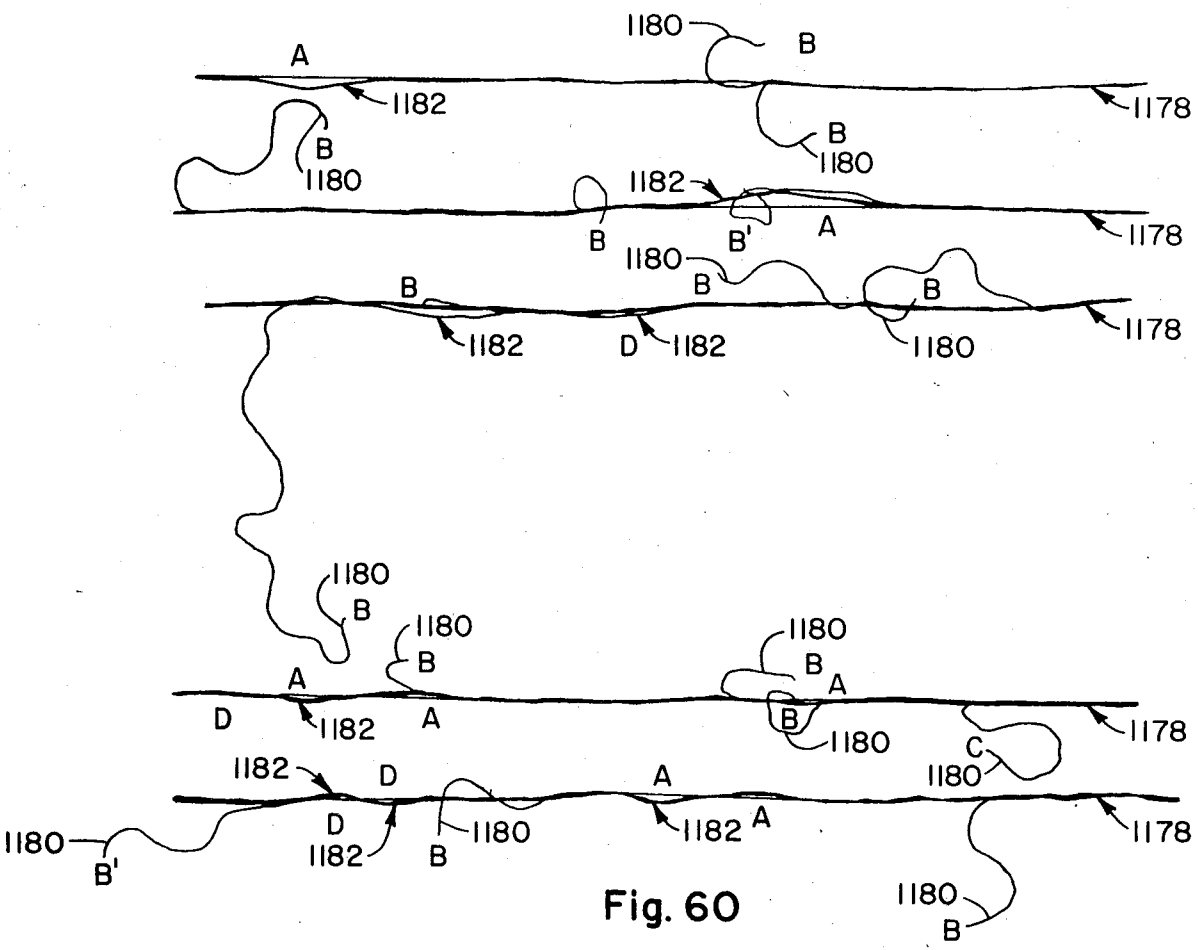
FIG. 60 shows tracings of fibers from a yarn to illustrate bridge loops and free protruding ends.

FIG. 60 herein shows tracings of a 22.5X enlargement of fibers from one such typical yarn. These single fibers were separated from yarn samples, mounted on transparent sheets for projection, and the projected shadow photographed at 22.5C using a microfilm reader-printer. The filaments 1178 in FIG. 60 were traced because the resulting negative photos were not clear enough to be reproduced herein. What appears to be "hairs" are not broken filaments but rather they represent small segments of fiber wings which have been torn away from the fiber body. The cross-sectional shape of the fibers is a necessary condition for the formation of these free protruding ends 1180.

In the turbulent violence of the air-jet fracturing process, there are very high stresses concentrated at the intersection of the wing member-body section. These stresses will sometimes cause a wing member to break away from the body section. If such a fracture or crack extends for some length along the fiber and the wing member is ruptured at some point, a free protruding end will result.

Figure 61:
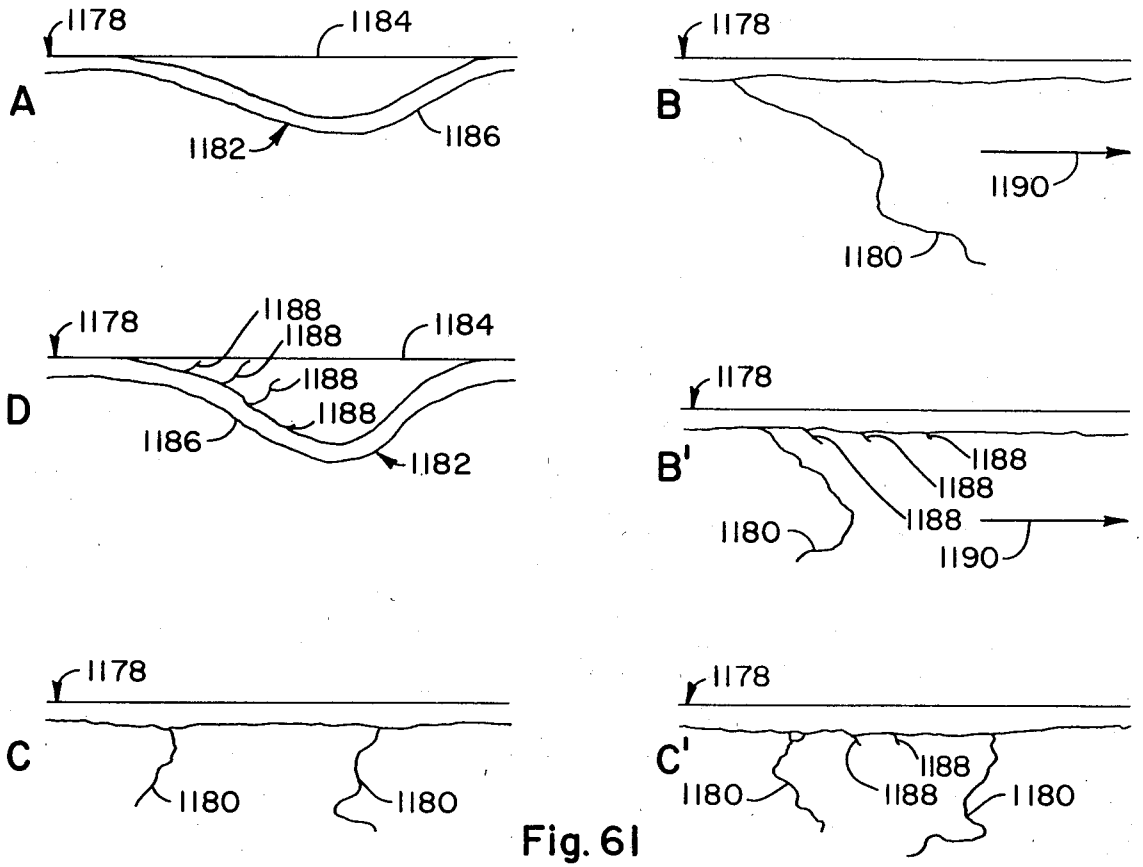
FIG. 61 illustrates six classifications of observed events occurring when yarn is fractured.

FIG. 61 shows what has been observed to be six classes of fibrils or free protruding ends. In Class A and D the wing member and body section remain intact but have separated from one another along their length. These classes are shown in FIG. 60. As disclosed in U.S. Pat. No. 4,245,001, these are known as "bridge loops". These bridge loops 1182 (FIG. 61) are visible loops, some of which break to provide the aforementioned free protruding ends 1180 and those that do not break always have the unusual fracture that the separated wing member is essentially straight, as shown at 1184, and the body section from which it is separated is curved, as shown at 1186. The separated wing member 1184 is unexpectedly shorter than the body section 1186 from which it is separated.

Class D (FIG. 61) is distinguished from Class A by the presence of very fine microfibrils 1188 within the loop, some of which may bridge the gap. The appearance of Class D suggests that the bridge loops begin as microcracks which propagate along the filament. Class D occurs when the initiation points are closely spaced, Class A occurs when the initiation points are widely spaced.

When the fibers are held under tension, it becomes obvious that there is a significant difference in the lengths of the separated wing members and of the body section of the fiber. I have no explanation for this phenomenon.

Rupture of the loaded wing members is distributed randomly over their lengths, giving rise to Classes C and C'. The probability of simple tensile fracture occurring exactly at the end of the loop, as in B and B', is zero. Interestingly, the fibrils of Class B and B' seem always to be anchored at the upstream end, as will be noted by the direction of the arrows 1190 or rather this appears to be the preferred direction for most of such filaments observed.

In summary, therefore, Class A shows a bridge loop 1182 where the loop is intact and there are no microfibril connectors. Class D shows a bridge loop 1182 where the loop is intact and there are microfibril connectors 1188. Class C shows a broken loop having no microfibril connectors. Class C' shows a broken loop having microfibril connectors 1188. Class B shows a simple free protruding and having no microfibril connectors. Class B' shows a simple free protruding end having microfibril connectors 1188.

The invention has been described in detail with particular reference to preferred embodiments thereof, but it will be understood that variations and modifications can be effected within the spirit and scope of the invention.

I claim:

1. Process for melt spinning a filament having a body section and at least one wing member, the process comprising (a) melt spinning a filament-forming polymeric material through a spinneret orifice the planar cross-section of which defines intersecting quadrilaterals in connected series with the L/W of each quadrilateral varying from 2 to 10 and with one or more of the defined quadrilaterals being greater in width than the width of the remaining quadrilaterals, with the wider quadrilaterals defining body sections and with the remaining quadrilaterals defining wing member to form a filament having a cross-section comprising said body section and said at least one wing member joined to said body section, said at least one wing member varying up to about twice its minimum thickness along its width, at the junction of said body section and said at least one wing member the respective faired surfaces thereof define a radius of concave curvatrue (Rc) on one side of said cross-section and a generally convex curve located on the other side of said cross-section generally opposite said radius of curvature (Rc), said body section comprising about 5 to about 75%, said filament being further characterized by a wing-body interaction (WBI) defined by $$WBI = \left[\frac{(Dmax - Dmin)Dmin}{2Rc^2}\right]\left[\frac{Lw}{Dmin}\right]^2 \geqq 1$$

where the ratio of the width of said filament cross-section to the wing member thickness ($L_T$/Dmin) is <30, Dmax is the maximum thickness of the body section, Dmin is the thickness of the wing member of essentically uniform wing members and the minimum thickness close to the body section when the thickness of the wing member is variable, Rc is the radius of curvatrue of the intersection of the wing member and body section, Lw is the overall length of an individual wing member and Lt is the overall length of the fillament cross-section;

(b) quenching said filament at a rate sufficient to maintain at least a wing-body interaction (WBI) of the spun filament; and (c) taking up said filament under tension.

2. Process for draw-fracturing yarn comprised of continuous filaments each having a cross-section comprising a body section and one or more wing members joined to said body section, said one or more wing members varying up to about twice their minimum thickness along their width, at the junction of the body section and said one or more wing members the respective faired surfaces thereof define a radius of concave curvature (RC) on one side of said cross-section and a generally convex curve located on the other side of said cross-section generally opposite said radius of curvature (RC), said body section comprising about 25 to about 95% of the total mass of the filament and said wing members comprising about 5 to about 75%, said filament being further characterized by a wing-body interaction (WBI) defined by $$WBI = \left[\frac{(Dmax - Dmin)Dmin}{2Rc^2}\right]\left[\frac{Lw}{Dmin}\right]^2 \geqq 1$$

where the ratio of the width of said filament cross-section to the wing member thickness ($L_T$/Dmin) is $\leqq 30$, Dmax is the maximum thickness of the body section, Dmin is the thickness of the wing member for essentially uniform wing members and the minimum thickness close to the body section when the thickness of the wing member is variable, RC is the radius of curvature of the intersection of the wing member and body section, Lw is the overall length of an individual wing member and $L_T$ is the overall length of the filament cross-section; said process comprising uniformly drawing said yarn to a preselected level of textile utility, stabilizing said yarn to a boiling water shrinkage of $\leqq 15\%$, fracturing the wing member portion of said filament utilizing fracturing means, and taking up said yarn.

3. Process of claim 2 wherein said fracturing means comprises a fluid fracturing jet operating at a brittleness parameter (Bp*) of about 0.03–0.8 for the yarn being fractured.

4. Process of claim 3 wherein said yarn is a poly(ethylene terephthalate) yarn and said fracturing means is operated at a brittleness parameter (Bp*) of about 0.03–0.6.

5. Process of claim 3 wherein the specific volume of the fractured yarn is made to vary along the yarn strand by varying the fracturing jet air pressure.

6. Process of claim 2 wherein said fracturing means is operated at a brittleness parameter (Bp*) of about 0.03 to about 0.4.

* * * * *